US008573451B2

(12) United States Patent
Tryon

(10) Patent No.: US 8,573,451 B2
(45) **Date of Patent: *Nov. 5, 2013**

(54) ACTUATOR SYSTEMS AND METHODS FOR AEROSOL WALL TEXTURING

(75) Inventor: James A. Tryon, Seattle, WA (US)

(73) Assignee: Homax Products, Inc., Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/552,945

(22) Filed: Jul. 19, 2012

(65) Prior Publication Data

US 2013/0015275 A1 Jan. 17, 2013

Related U.S. Application Data

(63) Continuation of application No. 12/975,190, filed on Dec. 21, 2010, now abandoned, which is a continuation of application No. 11/982,132, filed on Oct. 31, 2007, now abandoned, which is a continuation of application No. 11/827,224, filed on Jul. 10, 2007, now abandoned, which is a continuation of application No. 11/102,205, filed on Apr. 9, 2005, now Pat. No. 7,240,857, which is a continuation of application No. 10/396,059, filed on Mar. 25, 2003, now Pat. No. 6,883,688, which is a continuation of application No. 09/989,958, filed on Nov. 21, 2001, now Pat. No. 6,536,633, which is a continuation of application No. 09/458,874, filed on Dec. 10, 1999, now Pat. No. 6,328,185.

(51) Int. Cl.
*B65D 83/00* (2006.01)

(52) U.S. Cl.
USPC ..... 222/402.1; 222/394; 239/393; 239/394

(58) Field of Classification Search
USPC ..... 222/402.1, 402.17, 394; 239/337, 239/393–394, 397, 437–438, 600–601
See application file for complete search history.

(56) References Cited

U.S. PATENT DOCUMENTS

| | | | |
|---|---|---|---|
| 208,330 | A | 9/1878 | Palmer |
| 351,968 | A | 11/1886 | Derrick |

(Continued)

FOREIGN PATENT DOCUMENTS

| | | |
|---|---|---|
| CA | 770467 | 10/1967 |
| CA | 976125 | 10/1975 |

(Continued)

OTHER PUBLICATIONS

Homax Products, Inc., "Easy Touch Spray Texture" brochure, Mar. 1992, 1 page.

(Continued)

*Primary Examiner* — Frederick C Nicolas
(74) *Attorney, Agent, or Firm* — Michael R. Schacht; Schacht Law Office, Inc.

(57) ABSTRACT

An outlet assembly for a spray dispenser comprises an actuator member, an outlet member, and an adjustment member. The actuator member comprises a stem portion, a first displacement surface portion, and at least one finger. The outlet member is arranged adjacent to the actuator member such that the outlet member and the actuator member define a dispensing path and the outlet member is adjacent to the at least one finger. The adjustment member is arranged relative to the actuator member. Movement of the adjustment member relative to the actuator member displaces the adjustment member relative to the actuator member to deform the at least one finger. As the at least one finger deforms, the at least one finger deforms the outlet member to alter a cross-sectional area of the outlet opening.

3 Claims, 23 Drawing Sheets

(56) References Cited

U.S. PATENT DOCUMENTS

| | | | |
|---|---|---|---|
| D25,916 | S | 8/1896 | Woods |
| 568,876 | A | 10/1896 | Regan |
| 579,418 | A | 3/1897 | Bookwalter |
| 582,397 | A | 5/1897 | Shone |
| 658,586 | A | 9/1900 | Reiling |
| 930,095 | A | 8/1909 | Seagrave |
| 931,757 | A | 8/1909 | Harmer |
| 941,671 | A | 11/1909 | Campbell |
| 1,093,907 | A | 4/1914 | Birnbaum |
| 1,154,974 | A | 9/1915 | Custer |
| 1,486,156 | A | 3/1924 | Needham |
| 2,127,188 | A | 8/1938 | Schellin et al. |
| 2,149,930 | A | 3/1939 | Plastaras |
| D134,562 | S | 12/1942 | Murphy |
| 2,307,014 | A | 1/1943 | Becker et al. |
| 2,320,964 | A | 6/1943 | Yates |
| 2,353,318 | A | 7/1944 | Scheller |
| 2,388,093 | A | 10/1945 | Smith |
| 2,530,808 | A | 11/1950 | Cerasi |
| 2,565,954 | A | 8/1951 | Dey |
| 2,686,652 | A | 8/1954 | Carlson et al. |
| 2,723,200 | A | 11/1955 | Pyenson |
| 2,763,406 | A | 9/1956 | Countryman |
| 2,764,454 | A | 9/1956 | Edelstein |
| 2,785,926 | A | 3/1957 | Lataste |
| 2,790,680 | A | 4/1957 | Rosholt |
| 2,831,618 | A | 4/1958 | Soffer et al. |
| 2,839,225 | A | 6/1958 | Soffer et al. |
| 2,908,446 | A | 10/1959 | Strouse |
| 2,932,434 | A | 4/1960 | Abplanalp |
| 2,965,270 | A | 12/1960 | Soffer et al. |
| 1,968,441 | A | 1/1961 | Holcomb |
| 2,976,897 | A | 3/1961 | Beckworth |
| 2,997,243 | A | 8/1961 | Kolb |
| 3,083,872 | A | 4/1963 | Meshberg |
| 3,107,059 | A | 10/1963 | Frechette |
| 3,167,525 | A | 1/1965 | Thomas |
| 3,191,809 | A | 6/1965 | Schultz et al. |
| 3,196,819 | A | 7/1965 | Lechner et al. |
| 3,198,394 | A | 8/1965 | Lefer |
| 3,216,628 | A | 11/1965 | Fergusson |
| 3,246,850 | A | 4/1966 | Bourke |
| 3,258,208 | A | 6/1966 | Greenebaum, II |
| 3,284,007 | A | 11/1966 | Clapp |
| 3,314,571 | A | 4/1967 | Greenebaum, II |
| 3,317,140 | A | 5/1967 | Smith |
| 3,342,382 | A | 9/1967 | Huling |
| 3,346,195 | A | 10/1967 | Groth |
| 3,373,908 | A | 3/1968 | Crowell |
| 3,377,028 | A | 4/1968 | Bruggeman |
| 3,390,121 | A | 6/1968 | Burford |
| 3,414,171 | A | 12/1968 | Grisham et al. |
| 3,415,425 | A | 12/1968 | Knight et al. |
| 3,425,600 | A | 2/1969 | Abplanalp |
| 3,428,224 | A | 2/1969 | Eberhardt et al. |
| 3,433,391 | A | 3/1969 | Krizka et al. |
| 3,450,314 | A | 6/1969 | Gross |
| 3,467,283 | A | 9/1969 | Kinnavy |
| 3,472,457 | A | 10/1969 | McAvoy |
| 3,482,738 | A | 12/1969 | Bartels |
| 3,514,042 | A | 5/1970 | Freed |
| 3,544,258 | A | 12/1970 | Presant et al. |
| 3,548,564 | A | 12/1970 | Bruce et al. |
| 3,575,319 | A | 4/1971 | Safianoff |
| 3,592,359 | A | 7/1971 | Marraffino |
| 3,596,835 | A | 8/1971 | Smith et al. |
| 3,608,822 | A | 9/1971 | Berthoud |
| 3,613,954 | A | 10/1971 | Bayne |
| 3,648,932 | A | 3/1972 | Ewald et al. |
| 3,653,558 | A | 4/1972 | Shay |
| 3,698,645 | A | 10/1972 | Coffey |
| 3,700,136 | A | 10/1972 | Ruekberg |
| 3,703,994 | A | 11/1972 | Nigro |
| 3,704,811 | A | 12/1972 | Harden, Jr. |
| 3,704,831 | A | 12/1972 | Clark |
| 3,764,067 | A | 10/1973 | Coffey et al. |
| 3,773,706 | A | 11/1973 | Dunn, Jr. |
| 3,776,470 | A | 12/1973 | Tsuchiya |
| 3,776,702 | A | 12/1973 | Chant |
| 3,777,981 | A | 12/1973 | Probst et al. |
| 3,788,521 | A | 1/1974 | Laauwe |
| 3,795,366 | A | 3/1974 | McGhie et al. |
| 3,799,398 | A | 3/1974 | Morane et al. |
| 3,806,005 | A | 4/1974 | Prussin et al. |
| 3,811,369 | A | 5/1974 | Ruegg |
| 3,813,011 | A | 5/1974 | Harrison et al. |
| 3,814,326 | A | 6/1974 | Bartlett |
| 3,819,119 | A | 6/1974 | Coffey et al. |
| 3,828,977 | A | 8/1974 | Borchert |
| 3,848,778 | A | 11/1974 | Meshberg |
| 3,862,705 | A | 1/1975 | Beres et al. |
| 3,871,553 | A | 3/1975 | Steinberg |
| 3,891,128 | A | 6/1975 | Smrt |
| 3,912,132 | A | 10/1975 | Stevens |
| 3,913,803 | A | 10/1975 | Laauwe |
| 3,913,804 | A | 10/1975 | Laauwe |
| 3,913,842 | A | 10/1975 | Singer |
| 3,932,973 | A | 1/1976 | Moore |
| 3,936,002 | A | 2/1976 | Geberth, Jr. |
| 3,938,708 | A | 2/1976 | Burger |
| 3,975,554 | A | 8/1976 | Kummins et al. |
| 3,982,698 | A | 9/1976 | Anderson |
| 3,989,165 | A | 11/1976 | Shaw et al. |
| 3,991,916 | A | 11/1976 | Del Bon |
| 3,992,003 | A | 11/1976 | Visceglia et al. |
| 4,010,134 | A | 3/1977 | Braunisch et al. |
| 4,032,064 | A | 6/1977 | Giggard |
| 4,036,673 | A | 7/1977 | Murphy et al. |
| 4,045,860 | A | 9/1977 | Winckler |
| 4,089,443 | A | 5/1978 | Zrinyi |
| 4,096,974 | A | 6/1978 | Haber et al. |
| 4,117,951 | A | 10/1978 | Winckler |
| 4,129,448 | A | 12/1978 | Greenfield et al. |
| 4,147,284 | A | 4/1979 | Mizzi |
| 4,148,416 | A | 4/1979 | Gunn-Smith |
| 4,154,378 | A | 5/1979 | Paoletti et al. |
| 4,164,492 | A | 8/1979 | Cooper |
| RE30,093 | E | 9/1979 | Burger |
| 4,171,757 | A | 10/1979 | Diamond |
| 4,185,758 | A | 1/1980 | Giggard |
| 4,187,959 | A | 2/1980 | Pelton |
| 4,187,985 | A | 2/1980 | Goth |
| 4,198,365 | A | 4/1980 | Pelton |
| 4,238,264 | A | 12/1980 | Pelton |
| 4,275,172 | A | 6/1981 | Barth et al. |
| 4,293,353 | A | 10/1981 | Pelton et al. |
| 4,308,973 | A | 1/1982 | Irland |
| 4,310,108 | A | 1/1982 | Motoyama et al. |
| 4,322,020 | A | 3/1982 | Stone |
| 4,346,743 | A | 8/1982 | Miller |
| 4,354,638 | A | 10/1982 | Weinstein |
| 4,358,388 | A | 11/1982 | Daniel et al. |
| 4,370,930 | A | 2/1983 | Strasser et al. |
| 4,372,475 | A | 2/1983 | Goforth et al. |
| 4,401,271 | A | 8/1983 | Hansen |
| 4,401,272 | A | 8/1983 | Merton et al. |
| 4,411,387 | A | 10/1983 | Stern et al. |
| 4,417,674 | A | 11/1983 | Giuffredi |
| 4,438,221 | A | 3/1984 | Fracalossi et al. |
| 4,442,959 | A | 4/1984 | Del Bon et al. |
| 4,460,719 | A | 7/1984 | Danville |
| 4,482,662 | A | 11/1984 | Rapaport et al. |
| 4,496,081 | A | 1/1985 | Farrey |
| 4,546,905 | A | 10/1985 | Nandagiri et al. |
| 4,609,608 | A | 9/1986 | Solc |
| 4,641,765 | A | 2/1987 | Diamond |
| 4,683,246 | A | 7/1987 | Davis et al. |
| 4,702,400 | A | 10/1987 | Corbett |
| 4,728,007 | A | 3/1988 | Samuelson et al. |
| 4,744,495 | A | 5/1988 | Warby |
| 4,761,312 | A | 8/1988 | Koshi et al. |
| 4,793,162 | A | 12/1988 | Emmons |
| 4,804,144 | A | 2/1989 | Denman |
| 4,815,414 | A | 3/1989 | Duffy et al. |

(56) References Cited

U.S. PATENT DOCUMENTS

| | | | |
|---|---|---|---|
| 4,819,838 | A | 4/1989 | Hart, Jr. |
| 4,830,224 | A | 5/1989 | Brison |
| 4,839,393 | A | 6/1989 | Buchanan et al. |
| 4,854,482 | A | 8/1989 | Bergner |
| 4,870,805 | A | 10/1989 | Morane |
| 4,878,599 | A | 11/1989 | Greenway |
| 4,887,651 | A | 12/1989 | Santiago |
| 4,893,730 | A | 1/1990 | Bolduc |
| 4,896,832 | A | 1/1990 | Howlett |
| D307,649 | S | 5/1990 | Henry |
| 4,940,171 | A | 7/1990 | Gilroy |
| 4,949,871 | A | 8/1990 | Flanner |
| 4,953,759 | A | 9/1990 | Schmidt |
| 4,954,544 | A | 9/1990 | Chandaria |
| 4,955,545 | A | 9/1990 | Stern et al. |
| 4,961,537 | A | 10/1990 | Stern |
| 4,969,577 | A | 11/1990 | Werding |
| 4,969,579 | A | 11/1990 | Behar |
| 4,988,017 | A | 1/1991 | Schrader et al. |
| 4,991,750 | A | 2/1991 | Moral |
| 5,007,556 | A | 4/1991 | Lover |
| 5,009,390 | A | 4/1991 | McAuliffe, Jr. et al. |
| 5,037,011 | A | 8/1991 | Woods |
| 5,038,964 | A | 8/1991 | Bouix |
| 5,052,585 | A | 10/1991 | Bolduc |
| 5,059,187 | A | 10/1991 | Sperry et al. |
| 5,065,900 | A | 11/1991 | Scheindel |
| 5,069,390 | A | 12/1991 | Stern et al. |
| 5,100,055 | A | 3/1992 | Rokitenetz et al. |
| 5,115,944 | A | 5/1992 | Nikolich |
| 5,126,086 | A | 6/1992 | Stoffel |
| 5,169,037 | A | 12/1992 | Davies et al. |
| 5,182,316 | A | 1/1993 | DeVoe et al. |
| 5,188,263 | A | 2/1993 | Woods |
| 5,188,295 | A | 2/1993 | Stern et al. |
| 5,211,317 | A | 5/1993 | Diamond et al. |
| 5,297,704 | A | 3/1994 | Stollmeyer |
| 5,307,964 | A | 5/1994 | Toth |
| 5,310,095 | A | 5/1994 | Stern et al. |
| 5,312,888 | A | 5/1994 | Nafziger et al. |
| 5,314,097 | A | 5/1994 | Smrt et al. |
| 5,323,963 | A | 6/1994 | Ballu |
| 5,341,970 | A | 8/1994 | Woods |
| 5,368,207 | A | 11/1994 | Cruysberghs |
| 5,374,434 | A | 12/1994 | Clapp et al. |
| 5,405,051 | A | 4/1995 | Miskell |
| 5,409,148 | A | 4/1995 | Stern et al. |
| 5,417,357 | A | 5/1995 | Yquel |
| D358,989 | S | 6/1995 | Woods |
| 5,421,519 | A | 6/1995 | Woods |
| 5,425,824 | A | 6/1995 | Marwick |
| 5,450,983 | A | 9/1995 | Stern et al. |
| 5,467,902 | A | 11/1995 | Yquel |
| 5,476,879 | A | 12/1995 | Woods et al. |
| 5,489,048 | A | 2/1996 | Stern et al. |
| 5,498,282 | A | 3/1996 | Miller et al. |
| 5,501,375 | A | 3/1996 | Nilson |
| 5,505,344 | A | 4/1996 | Woods |
| 5,523,798 | A | 6/1996 | Hagino et al. |
| 5,524,798 | A | 6/1996 | Stern et al. |
| 5,544,783 | A | 8/1996 | Conigliaro |
| 5,548,010 | A | 8/1996 | Franer |
| 5,549,228 | A | 8/1996 | Brown |
| 5,558,247 | A | 9/1996 | Caso |
| 5,562,235 | A | 10/1996 | Cruysberghs |
| 5,570,813 | A | 11/1996 | Clark, II |
| 5,573,137 | A | 11/1996 | Pauls |
| 5,583,178 | A | 12/1996 | Oxman et al. |
| 5,597,095 | A | 1/1997 | Ferrara, Jr. |
| 5,639,026 | A | 6/1997 | Woods |
| 5,641,095 | A | 6/1997 | de Laforcade |
| 5,645,198 | A | 7/1997 | Stern et al. |
| 5,655,691 | A | 8/1997 | Stern et al. |
| 5,715,975 | A | 2/1998 | Stern et al. |
| 5,727,736 | A | 3/1998 | Tryon |
| 5,752,631 | A | 5/1998 | Yabuno et al. |
| 5,792,465 | A | 8/1998 | Hagarty |
| 5,799,879 | A | 9/1998 | Ottl et al. |
| 5,865,351 | A | 2/1999 | De Laforcade |
| 5,894,964 | A | 4/1999 | Barnes et al. |
| 5,915,598 | A | 6/1999 | Yazawa et al. |
| 5,921,446 | A | 7/1999 | Stern |
| 5,934,518 | A | 8/1999 | Stern et al. |
| 5,941,462 | A | 8/1999 | Sandor |
| 5,957,333 | A | 9/1999 | Losenno et al. |
| 5,975,356 | A | 11/1999 | Yquel et al. |
| 5,988,575 | A | 11/1999 | Lesko |
| 6,328,185 | B1 * | 12/2001 | Stern et al. ..... 222/402.1 |
| 6,536,633 | B2 * | 3/2003 | Stern et al. ..... 222/402.1 |
| 6,883,688 | B1 * | 4/2005 | Stern et al. ..... 222/402.1 |
| 7,240,857 | B1 * | 7/2007 | Stern et al. ..... 239/337 |
| 8,313,011 | B2 * | 11/2012 | Greer et al. ..... 222/402.1 |
| 8,317,065 | B2 * | 11/2012 | Stern et al. ..... 222/402.1 |

FOREIGN PATENT DOCUMENTS

| | | |
|---|---|---|
| CA | 1191493 | 8/1985 |
| CA | 1210371 | 8/1986 |
| CA | 2145129 | 9/1995 |
| CA | 2090185 | 10/1998 |
| CH | 680849 | 11/1992 |
| DE | 210449 | 5/1909 |
| DE | 1926796 | 3/1970 |
| DE | 3808438 | 4/1989 |
| DE | 3806991 | 9/1989 |
| FR | 463476 | 2/1914 |
| FR | 84727 | 4/1964 |
| FR | 1586067 | 2/1970 |
| FR | 2659847 | 9/1991 |
| GB | 867713 | 5/1961 |
| GB | 977860 | 12/1964 |
| GB | 1144385 | 5/1969 |
| JP | 461392 | 1/1971 |
| JP | 8332414 | 6/1995 |
| WO | 9418094 | 8/1994 |

OTHER PUBLICATIONS

Newman-Green, Inc., "Aerosol Valves, Sprayheads & Accessories Catalog", Apr. 1, 1992, pp. 14, 20, and 22.

* cited by examiner 160
174
162
176
164
172
166
136
126
124
158
168
170
D,E,F
$d_a$
$d_l$
X
$d_c$
A,G
128a
178
130
156
138
150
154
134
122
140
132
144
146
142
148
152

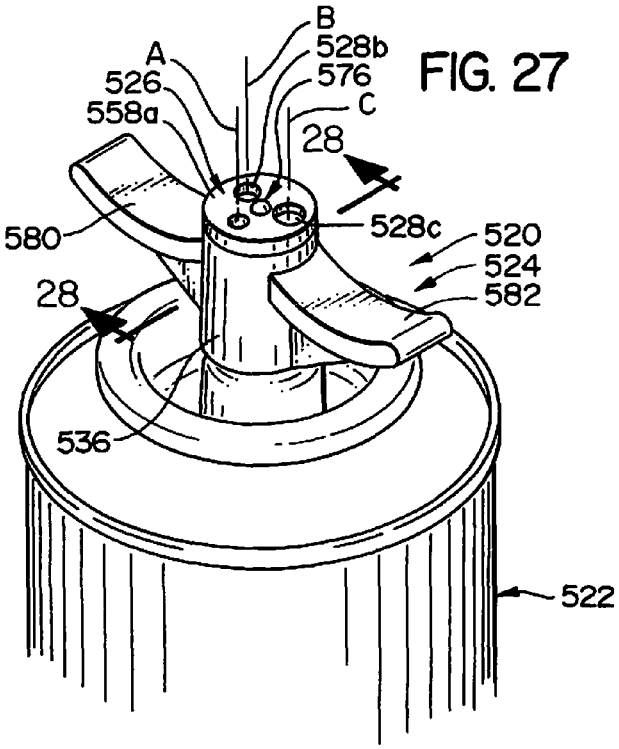
FIG. 27
FIG. 28
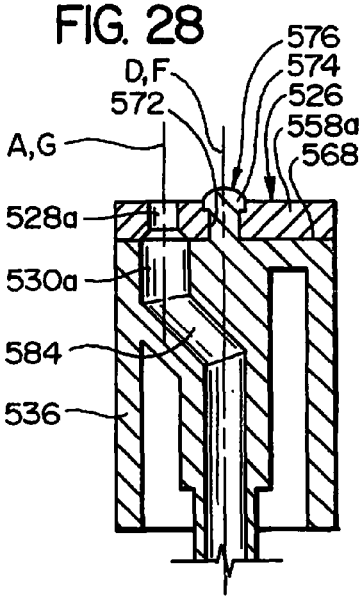
FIG. 29
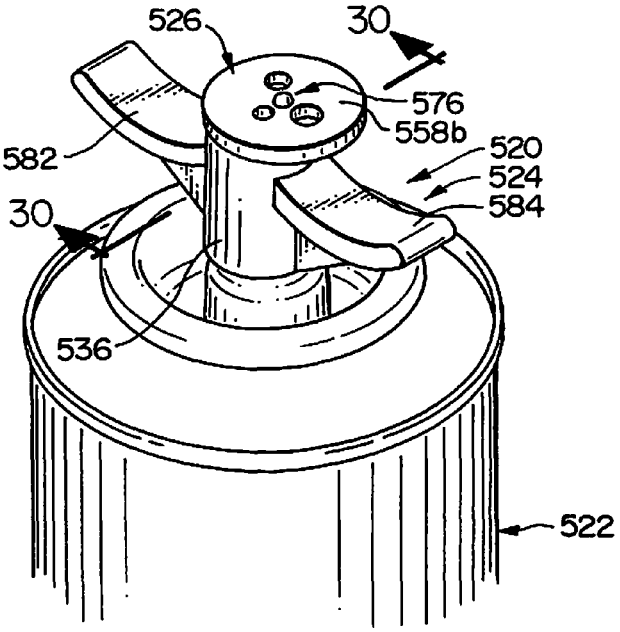
FIG. 30
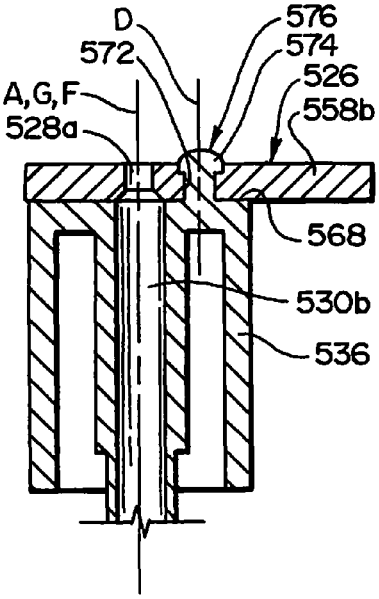

FIG. 31A
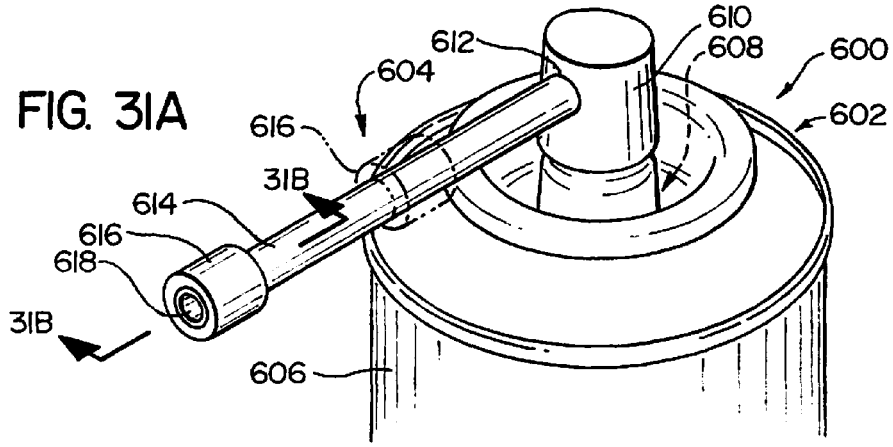
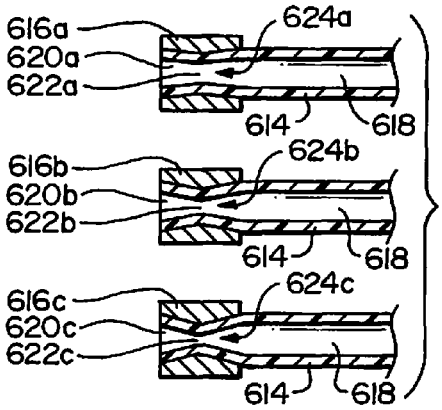
FIG. 31B
FIG. 33A
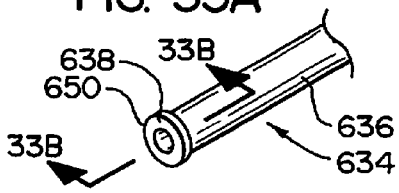
FIG. 32
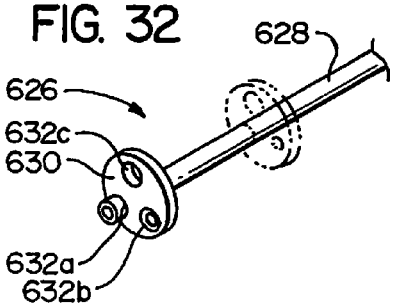
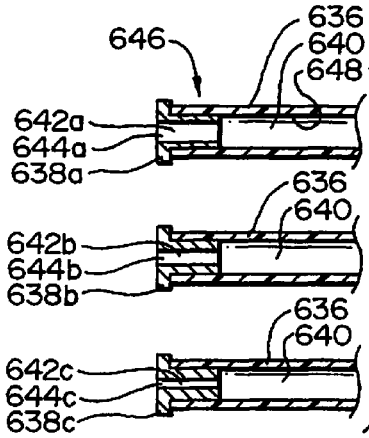
FIG. 33B

ACTUATOR SYSTEMS AND METHODS FOR AEROSOL WALL TEXTURING

RELATED APPLICATIONS

This application U.S. patent application Ser. No. 13/552,945 is a continuation of U.S. patent application Ser. No. 12/975,190 filed Dec. 21, 2010 now abandoned.

U.S. patent application Ser. No. 12/975,190 is a continuation of U.S. patent application Ser. No. 11/982,132 filed Oct. 31, 2007, now abandoned.

U.S. patent application Ser. No. 11/982,132 is a continuation of U.S. patent application Ser. No. 11/827,224 filed Jul. 10, 2007, now abandoned.

U.S. patent application Ser. No. 11/827,224 is a continuation of U.S. patent application Ser. No. 11/102,205 filed Apr. 9, 2005, now U.S. Pat. No. 7,240,857 which issued Jul. 10, 2007.

U.S. patent application Ser. No. 11/102,205 is a continuation of U.S. patent application Ser. No. 10/396,059 filed Mar. 25, 2003, now U.S. Pat. No. 6,883,688 which issued Apr. 26, 2005.

U.S. patent application Ser. No. 10/396,059 is a continuation of U.S. patent application Ser. No. 09/989,958 filed Nov. 21, 2001, now U.S. Pat. No. 6,536,633 which issued Mar. 25, 2003.

U.S. patent application Ser. No. 09/989,958 is a continuation of U.S. patent application Ser. No. 09/458,874 filed Dec. 10, 1999, now U.S. Pat. No. 6,328,185 which issued Dec. 11, 2001.

The contents of all related applications listed above are incorporated herein by reference.

TECHNICAL FIELD

The present invention relates to the art of spray texturing, and more particularly to systems and methods by which spray texturing can be accomplished to provide spray patterns of varying texture (i.e. with either finer or more coarse particle size).

BACKGROUND

When drywall panels are installed in a building, and the seams taped, prior to painting the wall surface, there is often applied a spray texture, which is followed by painting. The spray texture will provide a desirable background pattern, and also obscure some of the seams that might appear in the drywall surface.

There are in the prior art various spray texturing tools or devices which utilize pressurized air to spray the texture material onto the wall surface. Some of these use compressed air as the gaseous medium to spray the textured material, with the pressurized air being derived from a remote source that feeds the air through a hose to the tool. There are also tools which are totally handheld, with the pressurized air being produced by manually reciprocating the piston of an air pump that is built into the tool.

When an existing drywall surface is being repaired, quite often a small section of drywall will be removed and another piece of drywall put in its place. The seams of this piece of drywall must then be taped, and (if the surrounding surface is textured) then have a texture surface treatment that would make it match with the surrounding drywall surface. It is, of course, desirable to have the spray pattern on the patch match that of the surrounding surface.

Also, when a rather small "patch" of drywall is to be spray textured, there is the matter of convenience. One approach has been simply to provide the spray texture material in an aerosol can, and the textured material is dispensed directly from the can to be sprayed onto the drywall surface. However, one of the considerations is how this can be accomplished in a manner to provide proper matching of the texture with that which is on the surrounding drywall.

U.S. Pat. No. 5,037,011 (Woods) discloses such an aerosol texture spraying device where the spray texture material is dispensed directly from the nozzle of the aerosol can. In a commercial embodiment of a device such as this, when there is higher pressure in the container, there is a relatively fine spray pattern. For a more coarse pattern (i.e. with larger particle sizes), the can is inverted and the nozzle depressed to dispense a certain amount of the propellant gas for a few seconds. Then the can is turned upright and the spray texture material dispensed at a lower pressure to provide the spray pattern with larger particle sizes.

U.S. Pat. No. 5,310,095 issued to the present Applicant discloses an apparatus for discharging a spray texture material through a nozzle means having a nozzle discharge opening to dispense this material. There is further provided a first delivery tube means having a first discharge passageway of a first predetermined cross-sectional area. The material discharge apparatus is operated to cause the textured material to be discharged through the tube means. Then a second discharge tube means is positioned to receive material from the discharge nozzle means, and this second tube means has a second discharge passageway with a second predetermined cross-sectional area different from the first cross-sectional area. Thus, the '095 patent disclosed obtaining a finer spray pattern by utilizing a tube means with a passageway having a lesser cross-sectional area and a coarse pattern by discharging said material through the tube means having a greater cross-sectional area.

The need thus exists for spray texturing devices that are easy to use, allow the user to obtain at least a plurality of texture patterns, and are inexpensive to manufacture.

SUMMARY

The present invention may be embodied as an outlet assembly for a spray dispenser, comprising an actuator member, an outlet member, and an adjustment member. The actuator member comprises a stem portion, a first displacement surface portion, and at least one finger. The outlet member defines an outlet opening and is deformable. The adjustment member defines a second displacement surface portion and an adjustment edge. The outlet member is arranged adjacent to the actuator member such that the outlet member and the actuator member define a dispensing path and the outlet member is adjacent to the at least one finger. The adjustment member is arranged relative to the actuator member such that the first and second displacement surfaces engage each other and the adjustment edge is in contact with the at least one finger. Movement of the adjustment member relative to the actuator member displaces the adjustment member relative to the actuator member to cause the adjustment edge to deform the at least one finger. As the adjustment edge deforms the at least one finger, the at least one finger deforms the outlet member to alter a cross-sectional area of the outlet opening.

The present invention may also be embodied as an outlet assembly for a spray dispenser, comprising an actuator member, an outlet member, a first adjustment member, and a second adjustment member. The actuator member comprises a stem portion and an adjustment edge. The outlet member defines an outlet opening, where the outlet member is deformable. The first adjustment member defines a first displacement surface portion and at least one finger. The second adjustment member defines a second displacement surface portion. The outlet member is arranged adjacent to the actuator member and the first adjustment member such that the outlet member, the actuator member, and the first adjustment member define a dispensing path, the outlet member is adjacent to the at least one finger, and the adjustment edge is in contact with the at least one finger. The second adjustment member is arranged relative to the first adjustment member such that the first and second displacement surfaces engage each other. Movement of the first adjustment member relative to the second adjustment member displaces the first adjustment member relative to the actuator member to cause the adjustment edge to deform the at least one finger. As the adjustment edge deforms the at least one finger, the at least one finger deforms the outlet member to alter a cross-sectional area of the outlet opening.

The present invention may also be embodied as an outlet assembly for a spray dispenser comprising an actuator member, an outlet member, a first adjustment member, and a second adjustment member. The actuator member comprises a stem portion and at least one finger. The outlet member defines an outlet opening and is deformable. The first adjustment member defines a first displacement surface portion and an adjustment edge. The second adjustment member defines a second displacement surface portion. The outlet member is arranged adjacent to the actuator member such that the outlet member and the actuator member define a dispensing path and the outlet member is adjacent to the at least one finger. The first adjusting member is arranged adjacent to the actuator member such that the adjustment edge is in contact with the at least one finger. The second adjustment member is arranged relative to the first adjustment member such that the first and second displacement surfaces engage each other. Movement of the first adjustment member relative to the second adjustment member displaces the first adjustment member relative to the actuator member to cause the adjustment edge to deform the at least one finger. As the adjustment edge deforms the at least one finger, the at least one finger deforms the outlet member to alter a cross-sectional area of the outlet opening.

BRIEF DESCRIPTION OF THE DRAWING

FIG. 27 is a perspective view of another exemplary spray texturing apparatus constructed in accordance with, and embodying, the principles of the present invention;

FIG. 28 is a partial cut-away view taken along lines 28-28 in FIG. 27;

FIG. 29 is a perspective view of another exemplary spray texturing apparatus constructed in accordance with, and embodying, the principles of the present invention;

FIG. 30 is a partial cut-away view taken along lines 30-30 in FIG. 29;

FIG. 31A depicts an isometric view of a spray texturing apparatus constructed in accordance with, and embodying, the principles of the present invention;

FIG. 31B is a section view taken along lines **31*b*-31*b* in FIG. 31**A;

FIG. 32 is a perspective view of yet another exemplary embodiment of an aerosol texture material dispensing apparatus;

FIG. 33A is a perspective view showing a portion of a discharge assembly constructed in accordance with the present invention;

FIG. 33B are section views taken along lines **33*b* in FIG. 33**A;

FIG. 44 is a section view showing yet another exemplary discharge assembly adapted to dispense texture material on a ceiling surface or the like;

FIG. 45 is a section view showing a discharge assembly adapted to apply texture material to upper regions of a wall or a ceiling or the like;

DETAILED DESCRIPTION

Figure 1:
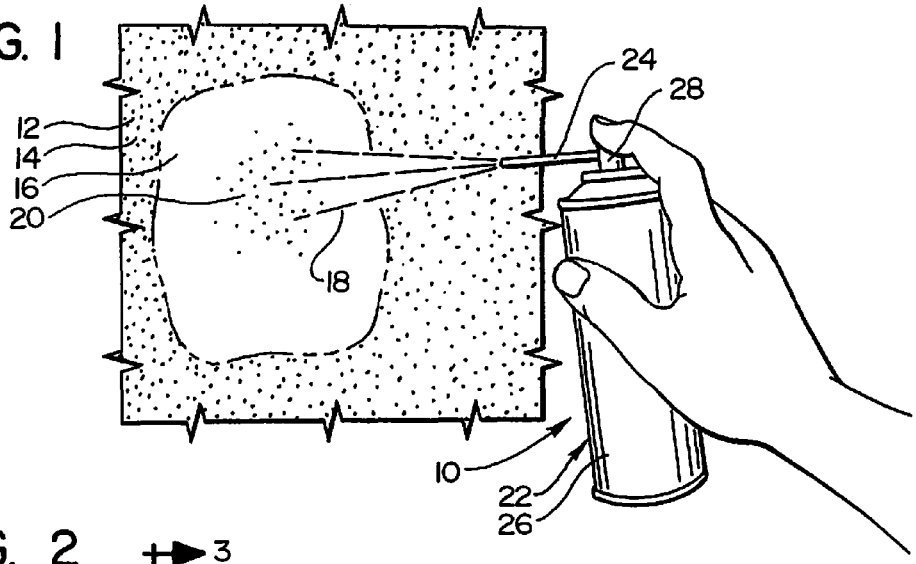
FIG. 1 is an isometric view illustrating a preferred embodiment of the present invention applying a spray texture material to a patch on a drywall surface.

FIG. 1 depicts and example apparatus or system 10 of the present invention being used in spraying the texture material onto a section of wallboard 12 having a previously sprayed surface portion 14 surrounding an unsprayed portion 16 which could be, for example, a more recently applied piece of wallboard that serves as a "patch". The spray itself is indicated at 18, and the spray material deposited on the wall portion 16 as a sprayed texture is indicated at 20.

Figure 2:
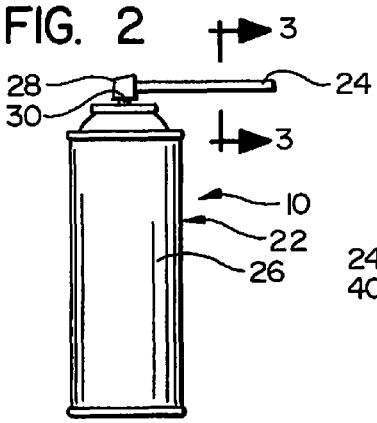
FIG. 2 is a side elevational view of the apparatus of the present invention.

With reference to FIG. 2, the present invention is shown, in one exemplary form, incorporated with an aerosol spray containing device 22, the basic design of which is or may be conventional in the prior art. Used in combination with this container 22 is a dispensing tube 24. It has been found by utilizing this dispensing tube 24 in particular arrangements to discharge the spray texture material, more precise control of the spray texture pattern can be achieved. Further, there are other advantages, in that not only is a more controllable spray pattern achieved, but this consistency of the spray pattern can be accomplished for a relatively long period of use. In other words, even after a substantial amount of the spray texture material has been already discharged from the aerosol dispensing container 22, the spray pattern remains rather consistent. The manner in which this is achieved will be described more fully later herein.

It is recognized that in the prior art tubular members have been used in combination with an aerosol spray can to deliver a material, such as a lubricant. To the best knowledge of the applicants, however, this use has been primarily to enable the aerosol container to deliver the fluid, such as a lubricating oil, to a somewhat inaccessible location, and not to achieve the ends of the present invention.

In the following detailed description of the invention, a number of embodiments of the present invention are described. These embodiments illustrate the present invention incorporates two features that may be used singly or together. These two features are the use of an elongate passageway through which texture material may pass before it exits an aerosol device and the use of a plurality of outlet orifice configurations, where by outlet orifice has a different cross-sectional area for each of the configurations. The technical advantages obtained by these features will be described in detail below.

The embodiments of the present invention described in this application illustrate that a given embodiment can contain one or both of these features and that these features can be implemented in a variety of different configurations.

Accordingly, the present application illustrates that, for a given set of design criteria, the designer has significant flexibility to construct an aerosol device for dispensing texture material that accomplishes the design goals inherent in the set of criteria.

To return to our description of the aerosol dispensing device 22, as indicated above, the basic design is or may be conventional. As shown herein, the device 22 comprises a cylindrical container 26 and a dispensing nozzle member 28 positioned at the top of the container 26. As is common in the prior art, this dispensing member 28 in its upright position blocks flow of material from the container 26. This dispensing member 28 is attached to a downwardly extending stem 30, and when the member 28 is depressed, a valve opens within the container 22 so that the material in the container 22 flows upwardly through the stem 30 and laterally out a nozzle formed in the dispensing nozzle member 28. Since the manner in which this is achieved is well known in the prior art, this will not be described in detail herein.

Figure 16:
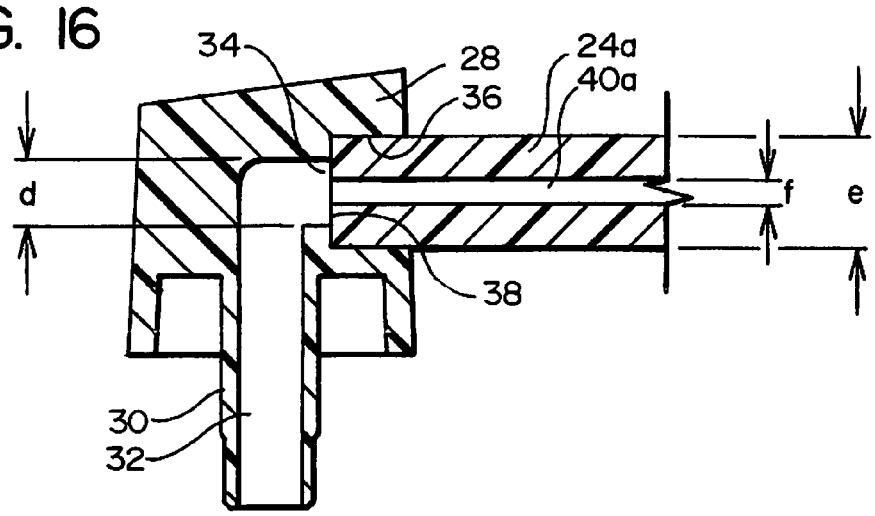
FIG. 16 is a cross sectional view taken through the actuator of the aerosol container, with this plane being coincident with the lengthwise axis of the dispensing tube and the vertical axis of the actuator, showing only the discharge orifice portion of the actuator, and further with the smaller inside diameter tube shown in FIG. 3.
Figure 17:
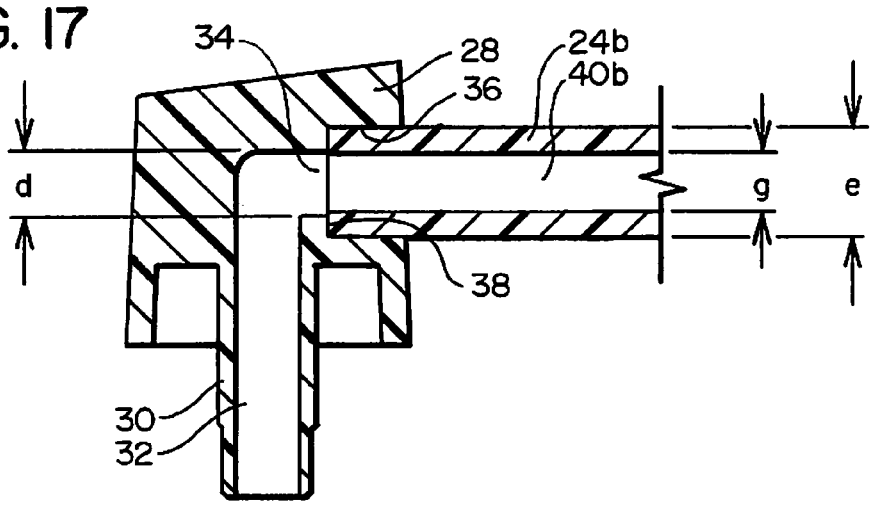
FIG. 17 is a view similar to FIG. 16, but showing the actuator having the medium inside diameter tube of FIG. 5 positioned therein.
Figure 18:
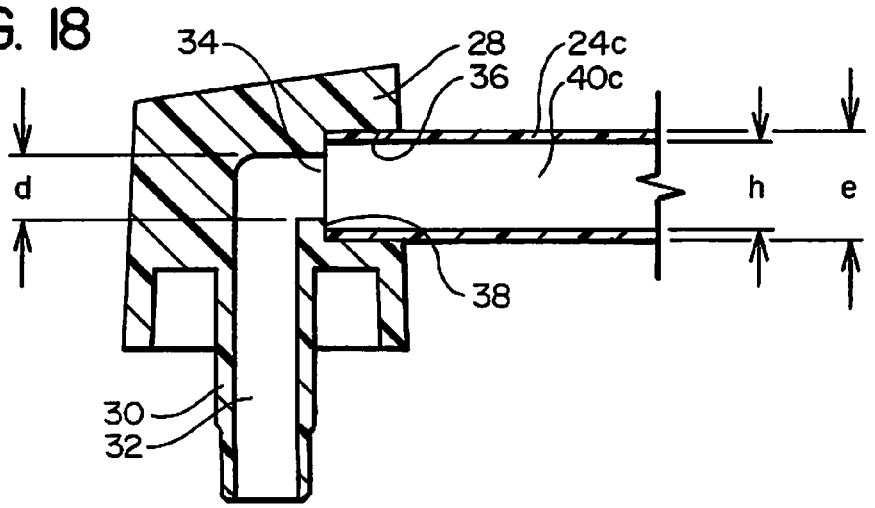
FIG. 18 is a view similar to FIGS. 16 and 17, but showing the dispensing tube of FIG. 7 having the largest inside diameter, as shown in FIG. 7.

Reference is now made to FIGS. 16 through 18, and it can be seen that the stem 30 provides a passageway 32 through which the spray texture material flows upwardly, and then is directed laterally to be discharged through a lateral nozzle opening 34. The passageway 32 and nozzle 34 can have their dimensions and configuration optimized for proper performance, and the manner in which this is done is also known in the prior art.

In the present invention, the nozzle member 28 is provided with a counterbore 36 having a moderately enlarged diameter, relative to the diameter of the nozzle opening 34. Both the nozzle opening 34 and the counter-bore 36 have a cylindrical configuration. The dispensing tube 24 has an outside diameter so that its end portion is able to fit snugly within the counterbore 36, with the end surface of the tube 34 bearing against the forwardly facing annular shoulder 38 defined by the counterbore 36 with the nozzle opening 34.

Figure 3:
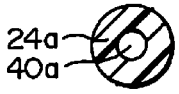
FIG. 3 is a sectional view taken along 3-3 of FIG. 2, this being done to illustrate the inside diameter of the discharge tube which is made relatively small to provide a spray texture pattern of a more fine particle size.
Figure 7:
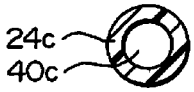
FIGS. 7 and 8 are similar to FIGS. 3 and 4, respectively, with FIG. 7 showing the cross section of a discharge tube of yet larger inside diameter for the flow passageway, and FIG. 8 showing the spray pattern with a yet larger particle size.

In the preferred embodiment of the present invention, a plurality of dispensing tubes 24 are provided, and in the present embodiment, there are three such tubes, 24*a*, 24*b* and 24*c*. It can be seen from examining FIGS. 3, 5 and 7 (and also FIGS. 16, 17 and 18) that the outside diameter of all three tubes 24*a*, 24*b*, and 24*c* have the same outside diameter, but different inside diameters for the discharge passageway 40.

Figure 4:
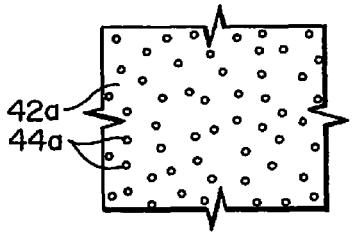
FIG. 4 illustrates somewhat schematically a spray texture pattern in a wall surface which has relative fine particle size.

It has been found that by selecting different diameters for the discharge passageway 40, the spray texture pattern can be controlled more accurately. With the smaller diameter 40*a* of the discharge tube 24*a*, shown in FIG. 3, a relatively fine spray texture pattern can be achieved, as shown in FIG. 4, where the particles of spray texture material are of a small particle size, as shown in the wall section 42*a*.

Figure 5:
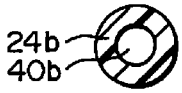
FIGS. 5 and 6 are views similar to FIGS. 3 and 4, with FIG. 5 showing a discharge passageway of a larger inside diameter, and FIG. 6 showing the spray pattern with a larger particle size.
Figure 8:
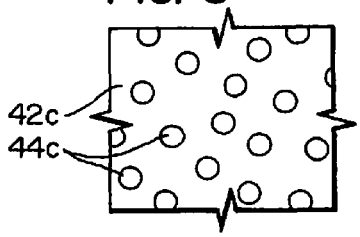

In FIG. 5, the interior discharge passageway 40*b* is of a more intermediate size, and this results in a discharge pattern which has a somewhat larger particle size, as shown in the wall section 42*b*. Then, with the yet larger diameter discharge opening 40*c*, as can be seen in FIG. 8, the wall section 42*c* having a spray texture pattern with a yet larger particle size. The particles of the board section 42*a*, 42*b*, and 42*c* are designated as, respectively, 44*a*, 44*b* and 44*c*.

With regard to the spray texture material itself, if has been found that quite desirable results can be achieved where the basic composition of the spray texture material comprises a resin or resins, particulate filler material and a propellant. Also, there is a solvent, and desirably dryers to accelerate the drying reaction of the resin with oxygen.

More specifically, the resin or resins desirably comprise alkyd resins, and more specifically those which are generally called bodying alkyds or puffing alkyds. Such alkyds are sometimes used for what are called "architectural coatings". The resins are made somewhat more gelatinous than would be used in other applications, this depending upon the spray characteristics that are desired. If the alkyd resins are made more gelatinous or viscous, a coarser spray pattern would be expected for a particular set of conditions.

The particulate filler material desirably has various particle sizes, and this can be a filler material or materials which are well known in the prior art, such as calcium carbonate, silica, talc, wollastonite, various types of pigments, etc.

The propellant is desirably a liquefied hydrocarbon gas, with this liquefied gas being dispersed throughout the texture material composition, such as being dissolved therein or otherwise dispersed therein. The propellant is characterized that under the higher pressure within the container the propellant remains dispersed or dissolved as a liquid throughout the spray texture material, and upon release of pressure, the propellant begins going back to its gaseous form to act as a propellant and push the material up the stem passageway 32 and out the nozzle opening 34.

The solvent is desirably aromatic and/or aliphatic hydrocarbons, ketones, etc.

The dryer or dryers would normally be a metallic dryer, such as various metal salts. These are already well known in the art, so these will not be described in detail herein.

It has been found that this type of texture material can be sprayed by using the present invention to provide a reasonably consistent spray texture for a given configuration of the tube 24. Also, it has been found that this consistency of spray pattern can be accomplished throughout the discharge of the great majority of the spray texture material within the container 26.

With regard to the particular dimensions utilized in this preferred embodiment of the present invention, reference is made to FIGS. 16 through 18. The diameter "d" of the nozzle orifice 34 is in this particular embodiment 0.102 inch, and the diameter of the counter-bore (indicated at "e") is 0.172 inch; the diameter "f" of the passageway 40*a* (i.e. the smallest diameter passageway) is 0.050 inch; the diameter "g" of the intermediate sized passageway 40*b* (see FIG. 17) is 0.095 inch; and the diameter "h" of the largest tube passageway 40*c* is 0.145 inch.

Thus, it can be seen in the arrangements of FIGS. 16 through 18 that in FIG. 16, there is a substantial reduction in the cross-sectional area of the passageway 40*a*, with this having about one half the diameter of the nozzle opening 34, so that the passageway area 40*a* is about one quarter of the nozzle opening 34.

In the intermediate size of FIG. 17, the diameter and cross-sectional area of the passageway 40*b* (indicated at "g") is nearly the same as that of the nozzle 34.

In FIG. 18, the diameter of the passageway 40*c* (indicated at "h") is slightly less than one and one half of the nozzle opening 34, and the cross sectional area is about twice as large.

Figure 9:
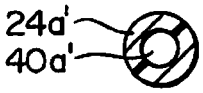
FIGS. 9, 10 and 11 correspond to, respectively, FIGS. 3, 5 and 7 and show a different arrangement of discharge tubes where the outside diameter varies.
Figure 10:
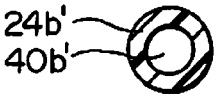
Figure 11:
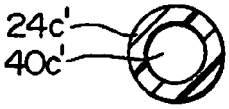

FIGS. 9, 10 and 11 show an alternative form of the tubes 24*a-c*, and these tubes in FIG. 9 through 11 (designated 24*a*', 24*b*' and 24*c*') have the same internal passageway cross-sectional area as the passageways 24*a*, 24*b* and 24*c*, respectively, but the outside diameter of these are made smaller, relative to the passageway size. If there is such varying outside diameters, then a plurality of mounting collars could be used, with these having consistent outside diameters, but varying inside diameters to fit around at least the smaller tubes of FIGS. 9 and 10.

Figure 12:
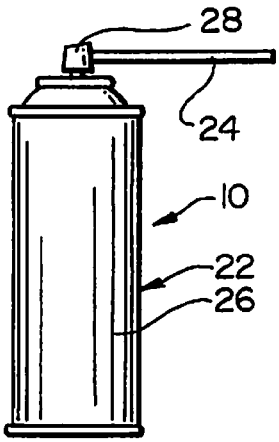
FIGS. 12, 13 and 14 illustrate the apparatus having tubes 24 of different lengths.
Figure 13:
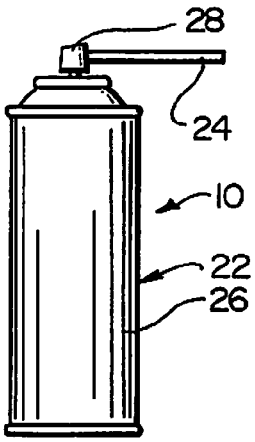
Figure 14:
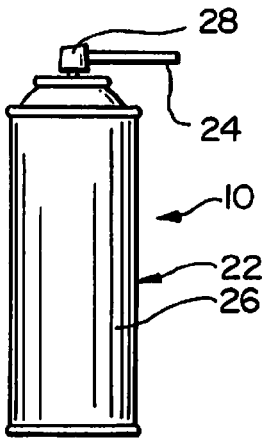

FIGS. 12 through 14 are simply shown to illustrate that the length of the tube 24 can be varied. It has been found that a rather desirable length of the tube 24 is approximately four inches. While a longer tube length could be used, in general there is no particular advantage in doing so since the proper consistency can be obtained with a tube of about four inches. Also, experiments have indicated that the length of the tube 24 can be reduced lower than four inches, possibly to two inches and even as low as one inch) without causing any substantial deterioration of the consistency and quality of the formation of the spray pattern. However, it has been found that somewhat more consistent results can be obtained if the length of the tube 24 is greater than one inch and at least as great or greater than two inches.

A tube length as short as one half inch has been tried, and this is able to provide a substantial improvement of performance over what would have been obtained simply by discharging the spray texture directly from the nozzle opening 34, without any tube, relative to controlling spray pattern. The shorter tube 24 (as small as one half inch) provides a significant benefit, but not the full benefit of the longer tube 24. The very short tube (e.g. one half inch) has a lesser quality of performance when used with the larger diameter passageway 40 than with the smaller passageway.

Figure 15:
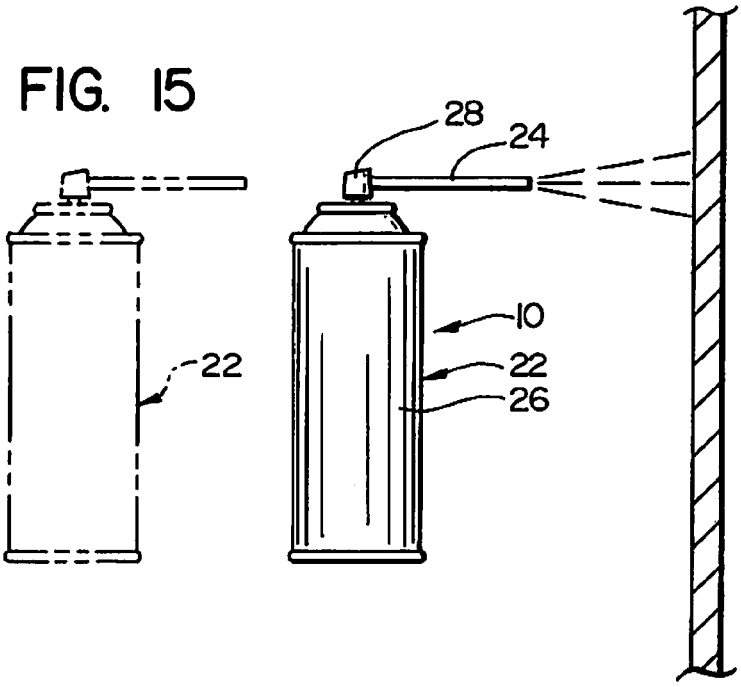
FIG. 15 is a side elevational view of the apparatus as shown being positioned closer to or further from a wall surface.

FIG. 15 illustrates that the texture pattern can also be controlled to some extent by moving the apparatus 10 closer to or farther away from the wall surface. If the apparatus 10 is moved rather close to the wall surface, the density of the applied material is increased for a given time of exposure. It has been found that in general satisfactory results can be obtained if the apparatus 10 is held approximately three feet from the wall surface. However, this will depend upon a number of factors, such as the pressure provided by the propellant, the character of the spray texture material, and other factors.

To describe now the operation of the present invention, an aerosol dispensing device 22 is provided as described previously herein with the spray texture material contained within the can 26 at a desired pressure. As is common with aerosol cans, it is desirable to shake the device 22 for a few seconds prior to depressing the nozzle control member 28.

If a relatively fine texture is desired, then a smaller diameter tube such as at 24*a* is used. For spray texture patterns having larger particle size, the larger diameter tube is used.

The person directs the nozzle opening 34 and the tube 24 toward the wall surface to be sprayed and depresses the nozzle member 28. As the spray texture material is discharged, the container 26 is moved back and forth and is tilted to different angles to spray the desired area.

As indicated earlier, it has been found that not only can a "fineness" or "coarseness" (i.e. smaller particle size or larger particle size, respectively) be controlled with reasonable precision by the present invention, but this consistency of the spraying pattern can be maintained throughout the discharge of the great majority of the spray material within the container 26. While these phenomena are not totally understood, it is believed that the following can be reasonably hypothesized to provide at least a partial explanation.

First, the separation of the texture material into particles of smaller or larger size is due in part to the character of the material itself, and also due in part to the way the forces are exerted on the material to tend to break it up into particles. More particularly, it can be hypothesized that if there is a greater shear force tending to separate the particles, it would be expected that there would be a finer pattern.

It is also recognized that when a fluid is moving through a conduit or tube, there is commonly what is called a velocity gradient along a transverse cross section of the flow of material. More precisely, the material immediately adjacent to the wall surface may have a very low velocity or practically no velocity. The adjacent material just a small distance away from the wall will have a somewhat greater velocity, but will still be retarded significantly due to the shear force provided by the material that is closer to the wall surface. As the cross section of the liquid material is analyzed closer toward the center, the shear force becomes less and the velocity becomes more uniform.

With the foregoing in mind, it also has to be recognized that if the diameter of the tube or conduit is reduced by one half, the cross-sectional area is reduced by one quarter. Thus, for the smaller tube (i.e. one half diameter) the surface area that provides a retarding force is doubled relative to the volume of flow at the same velocity). This would indicate that for a given cross-sectional segment of the fluid material being discharged, there is relatively greater shear force exerted for the smaller inside diameter tube. This would lead to the conclusion that for the discharge of a given amount of fluid at a certain velocity and at the same pressure, there would be a smaller particle size than if a tube of greater inside diameter were used.

Another phenomenon to be considered is with regard to the pressure which is forcing the textured material out of the tube 24. It can be surmised that if the pressure is greater, the velocity of the material traveling through the tube 24 would be greater, so that the shear forces exerted on the texture material would be greater so that smaller particle sizes would result.

It can be seen in FIG. 16 that the relatively small diameter passageway 40*a* serves as a restriction for the material flowing out the nozzle 34. This would tend to cause the velocity of the material flowing up the stem passageway 32 and out the nozzle opening 34 to decrease to some extent, but to have a relatively higher velocity out the passageway 40*a*. Further, it can be expected that the pressure of the propelling gas in the passageway 40*a* would be somewhat higher than if a larger diameter passageway such as 40*b* or 40*c* were utilized. Experimental results using different size tubes seem to verify this conclusion.

In FIG. 17, the diameter and cross-sectional area of the passageway 40*b* is nearly the same as that of the nozzle opening 34. Therefore it can be surmised that the velocity and pressure in the passageway 40*b* would be somewhat less than in the passageway 40*a*, this resulting in a somewhat larger particle size, and also a somewhat lower discharge velocity. Experimental results have verified this also.

Finally, with reference to FIG. 18, when the passageway diameter is larger than that of the nozzle opening 34 (as it is with the passageway 40*c*), it can be expected that the fluid discharged from the nozzle 34 would have a lower velocity and that there would be a lower propelling force provided by the propellant. Experimental results have indicated that this results in the coarser particle size.

However, it has to be recognized that while the above hypothesis can be proposed with reasonable justification, there are likely other phenomena involved which the applicants are either not aware of or have not fully evaluated. For example, with the propellant being disbursed in (and presumably dissolved in) the texture composition, it can be surmised that this propellant continues to go out of solution or dispersion into its gaseous form and expand to provide the propellant force, and this continues as the quantity of texture material continues to be reduced. This may also have a desirable effect on the formation of the particles and of the particle size, relative to consistency.

Nevertheless, regardless of the accuracy or correctness of the above explanations, it has been found that with the present invention, the spray pattern (and more particularly the particle size of the spray pattern) can be achieved with greater consistency and within relatively greater limits of particle size, than the prior art devices known to the applicants. Further, the consistency of the spray pattern can be maintained for the discharge of a large proportion of spray texture material from the apparatus 10.

It is to be recognized, of course, that various relative dimensions could be changed without departing from the basic teachings of the present invention. For example, it has been found that with spray texture material of a character which are acceptable in present day use, that a range of tube inside diameters of approximately one half of a tenth of an inch to one and one half tenth of an inch would give a reasonable range of texture spray patterns. However, it can be surmised that tube diameters outside of this range (e.g. one quarter of a tenth of an inch to possibly as high as one quarter of an inch would also provide acceptable texture spray patterns, depending upon a variety of circumstances, such as the viscosity and other characteristics of the spray texture material itself, the discharge pressure, the volumetric rate at which the spray texture material is delivered to the tube 24, and other factors.

Figure 19:
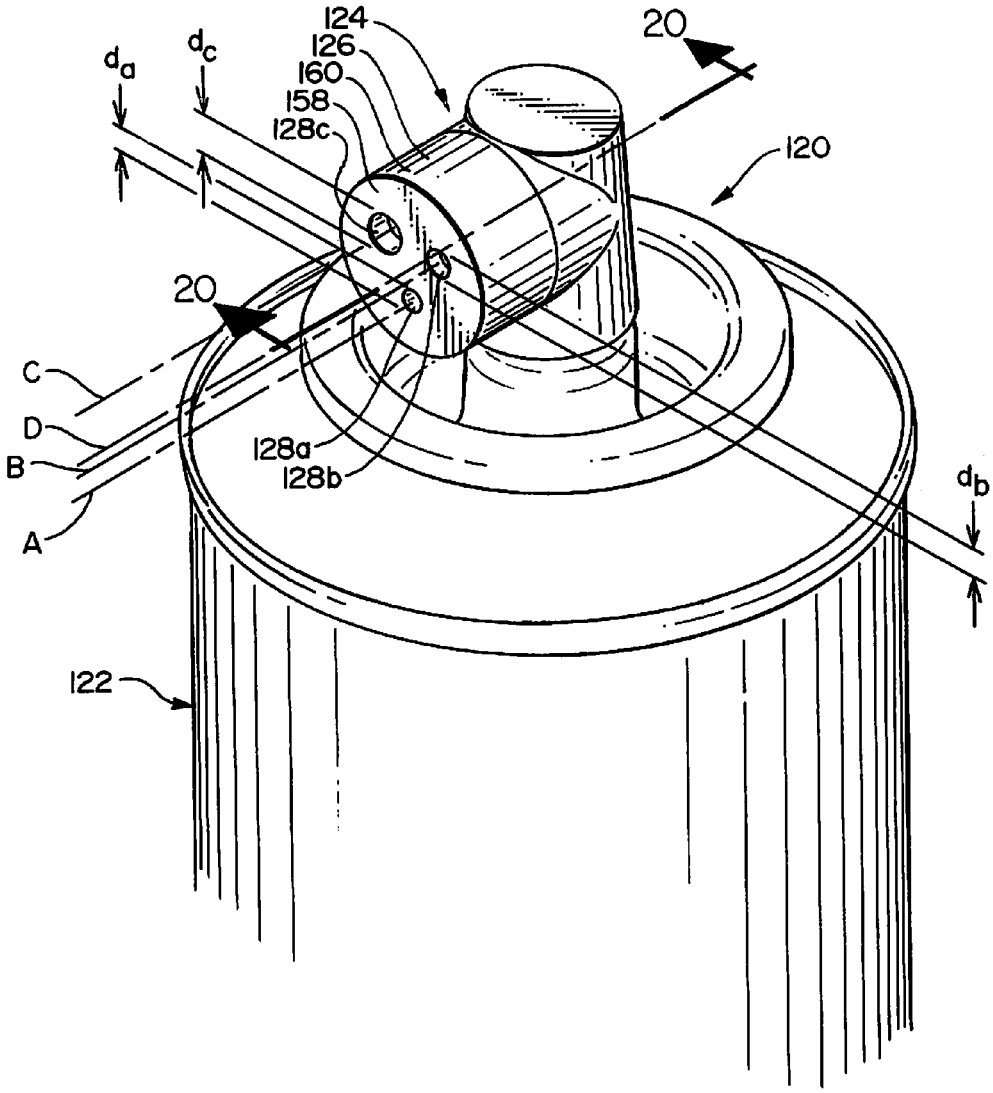
FIG. 19 is a perspective view of another exemplary spray texturing apparatus constructed in accordance with, and embodying, the principles of the present invention.
Figure 20:
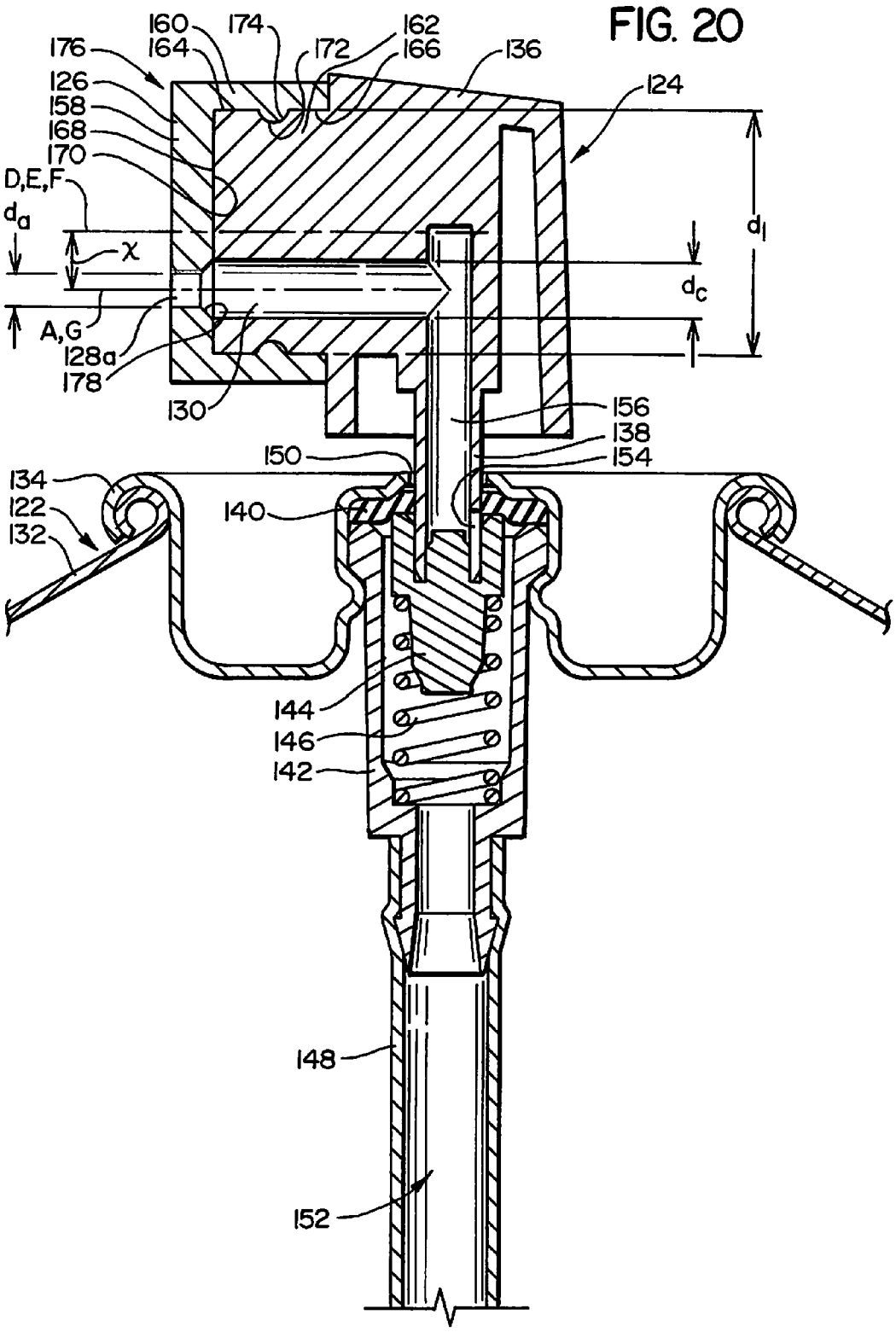
FIG. 20 is a partial cut-away view taken along lines 20-20 in FIG. 19.

Referring now to FIGS. 19 and 20, depicted therein at 120 is another exemplary spray texturing apparatus constructed in accordance with, and embodying, the principles of the present invention. The spray texturing apparatus 120 basically comprises an aerosol container 122, a valve assembly 124 mounted on the container 122, and an outlet member 126 attached to the valve assembly 124.

The outlet member 126 has first, second, and third outlet orifices 128*a*, 128*b*, and 128*c* formed therein. As shown in FIG. 19, these outlet orifices 128*a*, 128*b*, and 128*c* have of different diameters. Further, the outlet member 126 is so attached to the valve assembly 124 that each of the orifices 128*a*, 128*b*, and 128*c* aligned with a nozzle passageway 130 of the valve assembly 124 through which the texture material is dispensed or discharged. Aligning the orifices 128*a*, 128*b*, and 128*c* as just-described effectively extends the length of the nozzle passageway 130 in a manner that allows the operator to vary the cross-sectional area of a discharge opening 131 through which the texture material is discharged.

To operate the spray texturing apparatus 120, the valve assembly 124 is operated to allow the spray material within the container 122 to pass through the nozzle passageway 130. The texture material thus exits the spray texturing apparatus 120 through whichever of the outlet orifices 128*a*, 128*b*, or 128*c* is aligned with the nozzle passageway 130.

Figure 6:
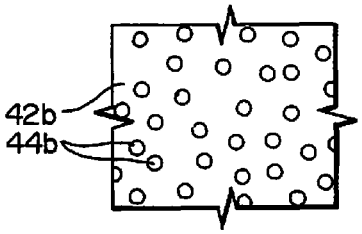

As shown in FIG. 20, the nozzle passageway 130 has a diameter of $d_o$. Similar to the dispensing tubes 24*a*, 24*b*, and 24*c* described above, the outlet orifices 128*a*, 128*b*, and 128*c* of different diameters $d_a$, $d_b$, and $d_c$ result in different spray texture patterns 20 being applied to the wallboard 12. One of the outlet orifices 128*a*, 128*b*, and 128*c* is selected according to the type of texture pattern desired and arranged to form a portion of the nozzle passageway 130, thereby varying the effective cross-sectional area of the discharge opening 131. The outlet orifice 128*a* is of the smallest diameter and results in a spray pattern having the small particles 44*a* as shown in FIG. 4. The outlet orifice 128*b* is of medium diameter and results in a spray pattern having the somewhat larger particles 44*b* shown in FIG. 5. The outlet orifice 128*c* is of the largest diameter, which results in a spray pattern having the large particles 44*c* shown in FIG. 6.

The spray texturing apparatus 120 obtains the same basic result as the apparatus 10 described above and the prior art assembly shown in FIGS. 27 and 28; however, as will be apparent from the following discussion, the apparatus 120 allows a reduction in the number of parts employed to achieve this result and substantially eliminates the possibility that individual parts will be lost by the end user. Also, the apparatus 120 is completely assembled at the factory and thus alleviates the potential for the operator to be sprayed with texture material during assembly.

Referring again to FIG. 20, the operation of the spray texturing apparatus 120 will now be described in further detail. The container 122 basically comprises a generally cylindrical base 132 and a cap 134. The base 132 and cap 134 are conventional and need not be described herein in detail.

The valve assembly 124 basically comprises: (a) the outlet member 128 described above; (b) an actuator member 136 having a valve stem 138; (c) a valve seat 140; (d) a valve housing 142; (e) a valve member 144; (f) a valve spring 146; and (g) a collection tube 148 that extends into the spray material within the container 122. Essentially, the valve assembly 124 creates a path that allows the pressure within the container 122 to cause the texture material to flow through the nozzle passageway 130.

The valve assembly 124 is constructed and operates basically as follows. The valve seat 140 and valve housing 142 mate with and are held by the container cap 134 near a valve hole 150 in the cap 134. The valve member 144 and valve spring 146 are mounted within the valve housing 142 such that the valve spring 146 urges the valve member 144 towards the valve seat 140. The valve stem 138 extends through the valve hole 150 and is attached to the valve member 144; pressing the actuator member 136 towards the container 122 into an open position forces the valve member 144 away from the valve seat 140 against the urging of the valve spring 146.

When the valve member 144 is forced away from the valve seat 140, an exit passageway 152 for the spray material is created. This exit passageway 152 allows the spray material to exit the apparatus 120 by passing: through the collection tube 148; through the center of the valve housing 142; around the valve member 144; through a slot 154 formed in the valve stem 138; through a vertical passageway 156 formed in the actuator member 136; through the nozzle passageway 130 described above; and through the one of the outlet orifices 128*a*, 128*b*, or 128*c* aligned with the nozzle passageway 130. At this point, the spray material forms the spray 18 as described above.

The exemplary outlet member 126 basically comprises a disc portion 158 and a cylindrical portion 160. The first, second, and third outlet orifices 128*a*, 128*b*, and 128*c* are formed in the disc portion 158. Center axes A, B, and C of the outlet orifices 128*a*, 128*b*, and 128*c* are equidistant from a center axis D of the disc portion 158; the distances between the center axes A, B, and C of these outlet orifices 128*a*, 128*b*, and 128*c* and the center axis D of the disc portion 158 are represented by the reference character X in FIG. 20.

The cylindrical portion 160 of the outlet member 126 has a center axis E which is aligned with the center axis D of the disc portion 158. Additionally, an outlet portion 162 of the actuator member 126 through which the nozzle passageway 130 extends has a generally cylindrical outer surface 164. A center axis F of the actuator member outer surface 164 is aligned with the center axes D and E described above.

Also, a center axis G of the nozzle passageway 130 is arranged parallel to the center axis F of the actuator member outer surface 164. The center axis G of this nozzle passageway 130 is spaced away from actuator member center axis F the same distance X that exists between the center axes A, B, and C of the nozzle exit orifices and the center axis D of the disc portion 158.

Finally, an inner surface 166 of the outlet member cylindrical portion 160 is cylindrical and has substantially the same diameter d, taking into account tolerances, as the cylindrical outer surface 164 of the outlet portion 162 of the actuator member 136. An outlet surface 168 of the outlet portion 162 is disc-shaped and has substantially the same diameter d as the outlet member inner surface 166 and the actuator member outer surface 164.

Accordingly, as shown in FIG. 20, the outlet member 126 is attached to the actuator member 136 by placing the cylindrical portion 160 of the outlet member 126 over the outlet portion 162 of the actuator member 136 such that the actuator member outlet surface 168 is adjacent to an inner surface 170 on the disc portion 158 of the outlet member 126.

When the outlet member 126 is so mounted on the actuator member 136, an annular projection 172 formed on the inner surface 166 of the outlet member cylindrical portion 160 engages an annular indentation 174 formed in the outer surface 164 of the actuator member outlet portion 162. The projection 172 and indentation 174 are arranged parallel to the actuator member outlet surface 168 and thus allow rotation of the outlet member 126 relative to the actuator member 136. Further, the engagement of the projection 172 with the indentation 174 prevents inadvertent removal of the outlet member 126 from the actuator member 136; however, both the projection 172 and indentation 174 are rounded to allow the outlet member 126 to be attached to and detached from the actuator member 136 when desired. The outlet member cylindrical portion 160, the projection 172, and indentation 174 thus form an attachment means 176 for rotatably attaching the outlet member 126 to the actuator member 136.

As shown in FIG. 20, when the outlet member 126 is attached to the actuator member 136, the center axes D, E, and F described above are aligned. Further, the outlet orifice center axes A, B, and C are parallel to the nozzle passageway center axis G.

Accordingly, any one of these outlet orifice center axes A, B, and C can be aligned with the nozzle passageway center axis G by rotation of the outlet member 126 about the axes D, E, and F relative to the actuator member 136. In FIG. 20, the center axis A of the first outlet orifice 128*a* is shown aligned with the nozzle passageway center axis G.

FIG. 20 also shows that an intermediate surface 178 is formed at one end of the first exit orifice 128*a*. This intermediate surface 178 brings the diameter of the exit passageway 152 gradually down from a diameter $d_o$ of the dispensing passageway 130 to the diameter $d_a$ of the first exit orifice 128*a*. A similar intermediate surface exists at one end of the second exit orifice 128*b*. An intermediate surface is not required for the third exit orifice 128*c* as, in the exemplary apparatus 120, the diameter $d_c$ of the third exit orifice is the same as that of the diameter $d_o$ of the nozzle passageway 130.

Figure 21:
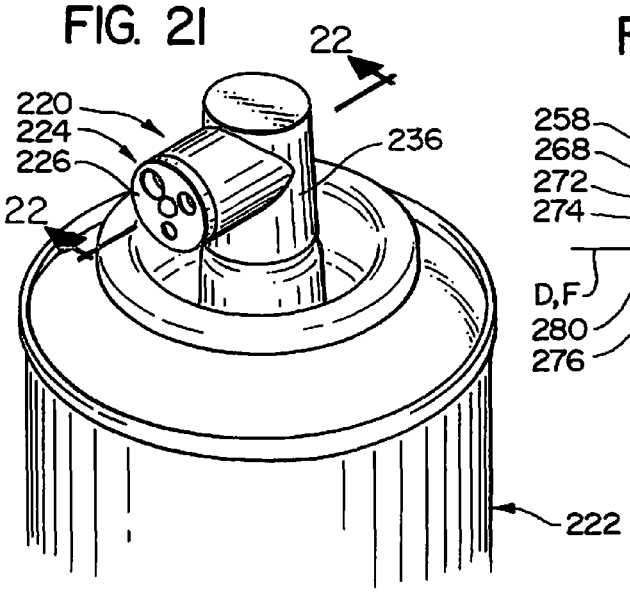
FIG. 21 is a perspective view of another exemplary spray texturing apparatus constructed in accordance with, and embodying, the principles of the present invention.
Figure 22:
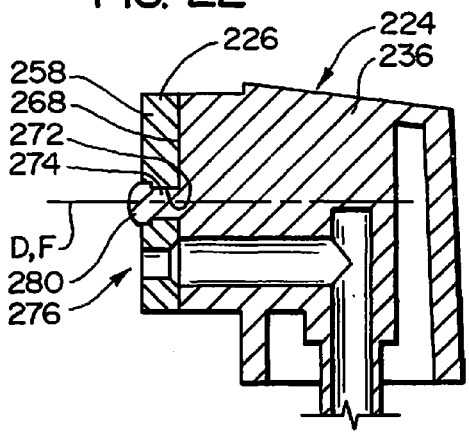
FIG. 22 is a partial cut-away view taken along lines 22-22 in FIG. 21.

Referring now to FIGS. 21 and 22, depicted therein at 220 is yet another exemplary spray texturing apparatus constructed in accordance with, and embodying, the principles of the present invention. The spray texturing apparatus 220 operates in the same basic manner as the apparatus 120 just-described; accordingly, the apparatus 220 will be described herein only to the extent that it differs from the apparatus 120. The characters employed in reference to the apparatus 220 will be the same as those employed in reference to the apparatus 120 plus 100; where any reference characters are skipped in the following discussion, the elements referred to by those skipped reference characters are exactly the same in the apparatus 220 as the elements corresponding thereto in the apparatus 120.

The spray texturing apparatus 220 basically comprises an aerosol container 222, a valve assembly 224 mounted on the container 222, and an outlet member 226 attached to the valve assembly 224. The valve assembly 224 further comprises an actuator member 236. The primary difference between the apparatus 120 and the apparatus 220 is in the construction of the outlet member 226 and the actuator member 236 and the manner in which these members 226 and 236 inter-operate.

In particular, the outlet member 226 simply comprises a disc portion 258. An attachment means 276 for attaching the outlet member 226 to the actuator member 236 basically comprises an indentation or hole 272 formed in the outlet member disc portion 258 and a projection 274 formed on an outlet surface 268 formed on the actuator member 236. The hole 272 and projection 274 lie along a center axis D of the disc portion 258 and a center axis F extending through the actuator member 236. The interaction of the hole 272 and the projection 274 allow the outlet member 226 to be rotated about the axes D and F. A rounded end 280 of the projection 274 prevents inadvertent removal of the outlet member 226 from the actuator member 236.

Accordingly, it should be clear from the foregoing discussion and FIGS. 21 and 22 that the attachment means 276 accomplishes the same basic function as the attachment means 176 described above and thus that the apparatus 220 operates in the same basic manner as the apparatus 120 described above.

Figure 23:
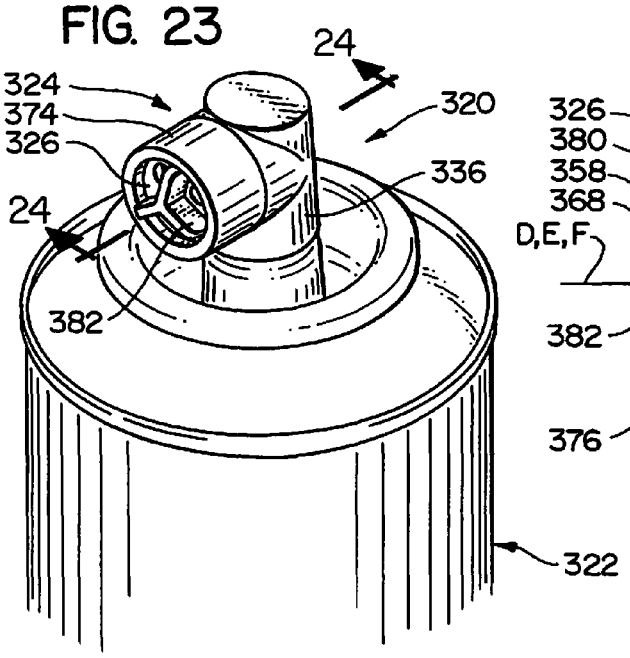
FIG. 23 is a perspective view of another exemplary spray texturing apparatus constructed in accordance with, and embodying, the principles of the present invention.
Figure 24:
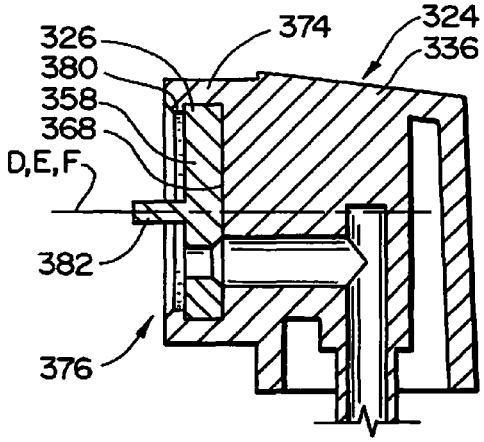
FIG. 24 is a partial cut-away view taken along lines 24-24 in FIG. 23.

Referring now to FIGS. 23 and 24, depicted therein at 320 is yet another exemplary spray texturing apparatus constructed in accordance with, and embodying, the principles of the present invention. The spray texturing apparatus 320 operates in the same basic manner as the apparatus 120 described above; accordingly, the apparatus 320 will be described herein only to the extent that it differs from the apparatus 120. The characters employed in reference to the apparatus 320 will be the same as those employed in reference to the apparatus 120 plus 200; where any reference characters are skipped in the following discussion, the elements referred to by those skipped reference characters are exactly the same in the apparatus 320 as the elements corresponding thereto in the apparatus 120.

The spray texturing apparatus 320 basically comprises an aerosol container 322, a valve assembly 324 mounted on the container 322, and an outlet member 326 attached to the valve assembly 324. The valve assembly 324 further comprises an actuator member 336. The primary difference between the apparatus 120 and the apparatus 320 is in the construction of the outlet member 326 and the actuator member 336 and the manner in which these members 326 and 336 inter-operate.

In particular, the outlet member 326 simply comprises a disc portion 358. An attachment means 376 for attaching the outlet member 326 to the actuator member 336 basically an annular ring 374 having a center axis E fastened to the actuator member 236. An annular projection 380 extends inwardly from the ring 374. The diameter of the disc portion 358 is substantially the same as that of the ring 374, taking into account tolerances, and slightly larger than that of the projection 380.

The outlet member 326 is attached to the actuator member 336 by placing the outlet member 326 within the ring 374 and attaching the ring 374 onto the actuator member 336 with: (a) the outlet member 326 between the annular projection 380 and an outlet surface 368 of the actuator member 336; and (b) a center axis D of the disc member 358 aligned with the axis E of the ring 374 and a center axis F of the actuator member 336. The outlet member 326 can rotate within the ring 374 about the axes D, E, and F, and the annular projection 380 prevents inadvertent removal of the outlet member 326 from the actuator member 336. A handle 382 is provided on the outlet member 326 to facilitate rotation outlet member 326.

The attachment means 376 accomplishes the same basic function as the attachment means 176 described above. The apparatus 320 thus operates in all other respects in the same basic manner as the apparatus 120 described above.

Figure 25:
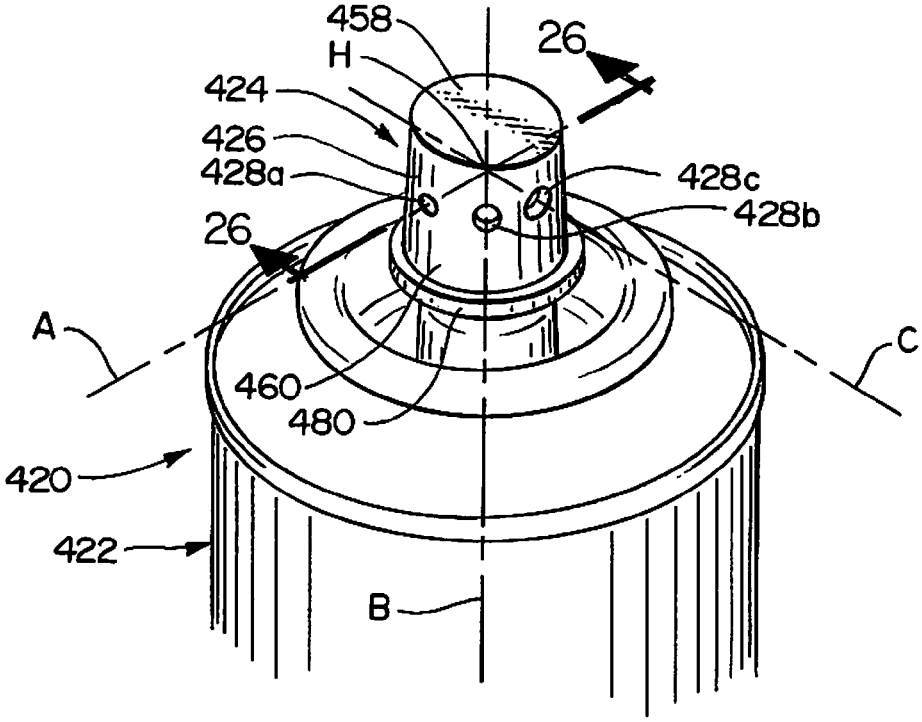
FIG. 25 is a perspective view of another exemplary spray texturing apparatus constructed in accordance with, and embodying, the principles of the present invention.
Figure 26:
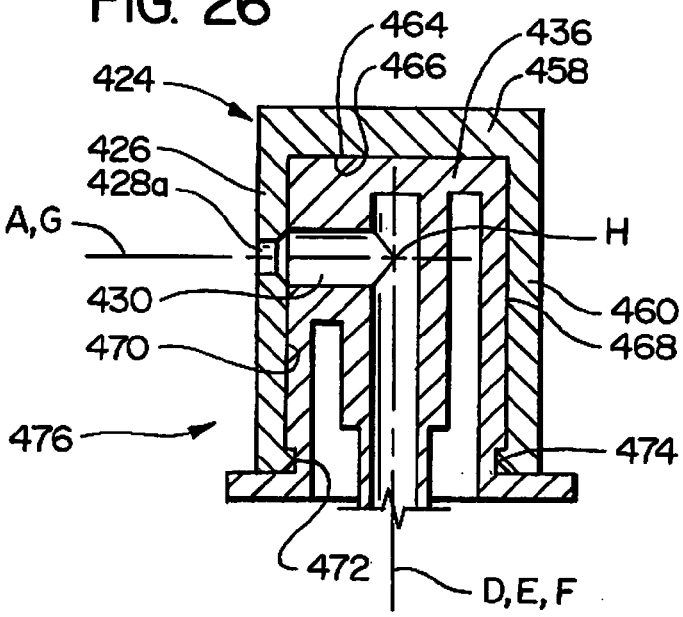
FIG. 26 is a partial cut-away view taken along lines 26-26 in FIG. 25.

Referring now to FIGS. 25 and 26, depicted therein at 420 is yet another exemplary spray texturing apparatus constructed in accordance with, and embodying, the principles of the present invention. The spray texturing apparatus 420 operates in the same basic manner as the apparatus 120 described above; accordingly, the apparatus 420 will be described herein only to the extent that it differs from the apparatus 120. The characters employed in reference to the apparatus 420 will be the same as those employed in reference to the apparatus 120 plus 300; where any reference characters are skipped in the following discussion, the elements referred to by those skipped reference characters are exactly the same in the apparatus 420 as the elements corresponding thereto in the apparatus 120.

The spray texturing apparatus 420 basically comprises an aerosol container 422, a valve assembly 424 mounted on the container 422, and an outlet member 426 attached to the valve assembly 424. The valve assembly 424 further comprises an actuator member 436. The primary difference between the apparatus 120 and the apparatus 420 is in the construction of the outlet member 426 and the actuator member 436 and the manner in which these members 426 and 436 inter-operate.

In particular, the outlet member 426 comprises a disc portion 458 having a lower surface 466 and a cylindrical portion 460 having an inner surface 470. In the exemplary apparatus 420, the actuator member 436 has an upper surface 464 and a cylindrical outer surface 468. When the valve assembly 424 is assembled, a center axis D of the disc portion 458, a center axis E of the cylindrical portion 460, and a vertical center axis F of the stem portion 436 are aligned.

An attachment means 476 for attaching the outlet member 426 to the actuator member 436 basically comprises an annular ring 472 formed on the outlet member cylindrical portion 460 and a notch or indentation 474 formed around the cylindrical outer surface 468 of the actuator member 436. This attachment means 476 allows the outlet member 426 to rotate relative to the actuator member 436 about the axes D, E, and F but prevents inadvertent removal of the outlet member 426 from the actuator member 436.

With this configuration, the first, second, and third outlet orifices 428*a*, 428*b*, and 428*c* are formed in the cylindrical portion 460 of the outlet member 426. These orifices 428*a*, 428*b*, and 428*c* are formed with their center axes A, B, and C orthogonal to, arranged at a given vertical point H along, and radially extending outwardly from the vertical center axis F of the stem portion 436. A center axis G of a nozzle passageway 430 formed in the actuator member 436 also is orthogonal to, radially extends from, and intersects at the given point H the vertical center axis F of the stem portion 436.

To facilitate rotation of the outlet member 426 relative to the actuator member 436, a peripheral flange 480 is formed at the bottom of the actuator member 436. The user can grasp this flange 480 to hold the actuator member 436 in place as the outlet member 426 is being rotated about its axis D.

Thus, rotation of the outlet member 426 relative to the actuator member 436 about the axes D, E, and F allows any one of these orifices 428*a*, 428*b*, and 428*c* to be aligned with a center axis G of a nozzle passageway 430 formed in the actuator member 436. The first outlet orifice 428*a* is shown aligned with the nozzle passageway 430 in FIG. 26.

The attachment means 476 thus also accomplishes the same basic function as the attachment means 176 described above. Accordingly, the apparatus 420 operates in all other respects in the same basic manner as the apparatus 120 described above.

Referring now to FIGS. 27, 28, 29, and 30, depicted therein at 520 is another exemplary spray texturing apparatus constructed in accordance with, and embodying, the principles of the present invention. The spray texturing apparatus 520 operates in the same basic manner as the apparatus 120 described above; accordingly, the apparatus 520 will be described herein only to the extent that it differs from the apparatus 120. The characters employed in reference to the apparatus 520 will be the same as those employed in reference to the apparatus 120 plus 400; where any reference characters are skipped in the following discussion, the elements referred to by those skipped reference characters are exactly the same in the apparatus 420 as the elements corresponding thereto in the apparatus 120.

The spray texturing apparatus 520 basically comprises an aerosol container 522, a valve assembly 524 mounted on the container 522, and an outlet member 526 attached to the valve assembly 524. The valve assembly 524 further comprises an actuator member 536. The primary difference between the apparatus 120 and the apparatus 520 is in the construction of the outlet member 526 and the actuator member 536 and the manner in which these members 526 and 536 inter-operate.

In particular, in the apparatus 520 a nozzle passageway 530 formed in the actuator member 536 terminates at the top rather than the side of the actuator member 536. The outlet member 526 comprises a disc member 558 attached to an outlet surface 568 on the upper end of the actuator member 536. A hole 572 formed in the disc member 558 and a projection 574 formed on the outlet surface 568 comprise an attachment means 576 for attaching the outlet member 526 onto the actuator member 536.

The attachment means 576 allows the outlet member 526 to be rotated about a center axis D thereof relative to the actuator member 536 such that any one of the center axes A, B, or C of outlet orifices 528*a*, 528*b*, and 528*c* can be aligned with a center axis G of the nozzle passageway 520.

Finger engaging wings 580 and 582 are formed on the actuator member 536 to allow the user to depress the actuator member 536 and spray the texture material within the container without getting texture material on the fingers.

The nozzle passageway identified by the reference character 530*a* in FIG. 28 comprises a dog-leg portion 584 that allows a center axis G of the nozzle passageway 530*a* to be offset from a vertical center axis F of the stem portion 536 and the center axis D of the outlet member 526. In FIG. 30, the nozzle passageway 530*b* is straight and the center axis D of the outlet member 526 is offset from the vertical center axis F of the stem portion 536. In this case, the disc member 558*b* forming the outlet member 526 in FIGS. 29 and 30 has a larger diameter than does the disc member 558*a* forming the outlet member 526 in FIGS. 27 and 28.

Referring now to FIGS. 31A and B, depicted at 600 therein is an aerosol device constructed in accordance with, and embodying, the principals of the present invention. The device 600 basically comprises an aerosol assembly 602 and an outlet assembly 604. The aerosol assembly 602 is conventional and will be described below only briefly.

The aerosol assembly 602 comprises a container 606, a valve assembly 608, and an actuator member 610. As is well known in the art, depressing the actuator member 610 moves the valve assembly 608 into its open position in which an exit passageway is defined from the interior to the exterior of the container 606. This exit passageway terminates in a nozzle opening 612 formed in the actuator member 610.

The outlet assembly 604 comprises a straw 614 and one or more constricting members 616. The straw member 614 is adapted to fit into the nozzle opening 612 such that texture material exiting the aerosol portion 602 passes through a discharge opening 618 defined by the straw 614.

The restricting sleeves 616 are adapted to fit onto the straw 614. Additionally, as shown in FIG. 31 B, each of the constricting sleeves defines a sleeve passageway 620 into which the straw 614 is inserted. The sleeve passageways 620 each comprise a reduced diameter portion 622. The straw 614 is made out of flexible material such that, when the straw is inserted into the sleeve passageway 620, the reduced diameter portions 622 of the passageway 620 act on the straws 614 to create outlet portions 624 of the dispensing passageway 618 having different cross-sectional areas. Each of the outlet portions 624*a*, 624*b*, 624*c* defined as described above corresponds to a different texture pattern.

The outlet assembly 604 as described above thus results in at least four different texture patterns. One is formed by the straw 614 without any constricting sleeve mounted thereon, and three are formed by the different constricting sleeves 616*a*, 616*b*, and 616*c* shown in FIG. 31B.

Also, as shown in FIG. 31A, the constricting sleeve 616 may be mounted on the end of the straw 614 as shown by solid lines or at a central location along the length of the straw 614 as shown by broken lines.

The aerosol device 600 thus employs an elongate discharge opening as formed by the straw 614 and provides constricting sleeves 616 that allow a cross-sectional area of the discharge opening 618 to be reduced, thereby allowing the device 600 to dispense texture material in a manner that forms different texture patterns.

Referring now to FIG. 32, depicted therein is an alternate outlet assembly 626 that may be used in place of the outlet assembly 604 described above. The outlet assembly 626 comprises a straw 628 and a constricting disc 630. The straw 628 functions in a manner essentially the same as the straw 614 described above. The disc 630 defines three disc passageways 632*a*, 632*b*, and 632*c* which function in the same basic manner as the passageways 620*a*, 620*b*, and 620*c* described above.

The single constricting disc 630 thus performs essentially the same function as the three constricting sleeves 616*a*, 616*b*, and 616*c* described above. A possible advantage to the outlet portion 626 is that it requires the fabrication and storage of only two parts (the straw 628 and the disc 630) rather than four parts (the straw 614 and the constricting sleeves 616*a*, 616*b*, and 616*c*).

Referring now to FIGS. 33A and 33B, depicted therein is yet another outlet assembly 634 that may be used instead of the outlet assembly 604 described above.

The outlet assembly 634 comprises a straw 636 and one or more constricting plugs 638. The straw 636 is essentially the same as the straw 614 described above, although the straw 636 is preferably made out of more rigid material than that from which the straw 614 is made.

The straw 636 and plugs 638 define a discharge passageway 640 through which texture material must pass as it exits the aerosol portion 602. The discharge passageway 640 comprises an outlet portion 642 defined by a central bore 644 formed in the plugs 638. As shown in FIG. 33B, the plugs 642*a*, 642*b*, and 642*c* have bores 644*a*, 644*b*, and 644*c* of different cross-sectional areas. As the outlet portions 642*a*, 642*b*, and 642*c* of the exit passageway 640 are defined by the bores 644*a*, 644*b*, and 644*c*, these outlet portions also have different cross-sectional areas. The constricting plugs 638*a*, 638*b*, and 638*c* are mounted on the straw 636 in a manner that allows the outlet portion 634 to be reconfigured to define an exit passageway at least a portion of which can be increased or decreased. This allows the outlet portion 634 to cause the texture material to be deposited on a surface in different patterns.

A number of mechanisms can be employed to mount the constricting plugs 638 on to the straw 636. The exemplary configuration shown in FIGS. 33A and 33B employs a reduced diameter portion 646 adapted to fit snugly within a central bore 648 defined by the straw 636. The tolerances of the reduced diameter portion 646 and the walls defining the bore 648, along with the material from which the straw 636 and plug 638 are made, result in a friction fit that holds the constricting plug within the straw 636 as shown in FIGS. 33A and 33B.

An external flange 650 is formed on each of the constricting plugs 638 primarily to facilitate removal of these plugs 638 from the straw 636 when different spray texture patterns are required.

Figure 34A:
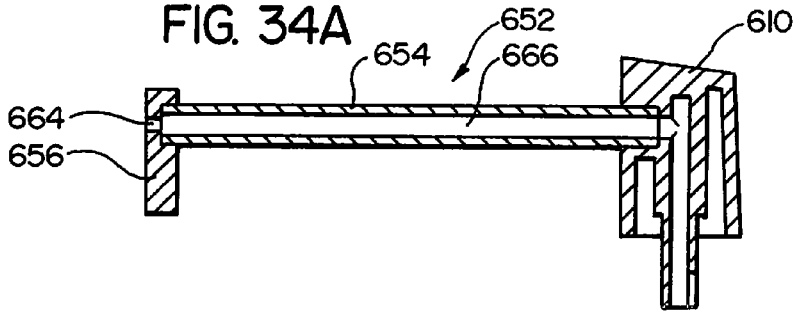
FIG. 34A is a section view depicting yet another exemplary discharge assembly constructed in accordance with the present invention.
Figure 34B:
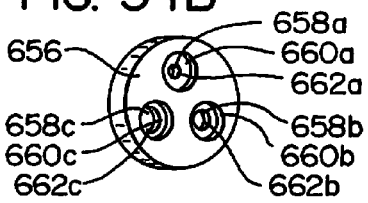
FIG. 34B is a perspective view showing one component of the discharge assembly shown in FIG. 34A.

Referring now to FIGS. 34A and 34B, depicted therein is yet another exemplary method of implementing the principles of the present invention. In particular, shown in FIG. 34A is yet another outlet assembly 652 adapted to be mounted on the aerosol assembly 602 in place of the outlet assembly 604 shown above.

In particular, the outlet assembly 652 comprises a straw 654 and a constricting disc 656. The straw 654 is mounted onto the actuator member 610, and the constricting disc 656 is mounted on a distal end of the straw 654.

The straw 654 is similar in shape to the straw 614 described above and it is similar in both shape and function to the straw 636 described above. In particular, the straw 654 is made out of semi-rigid material that allows a pressure fit to be formed that will mechanically engage the straw 654 both to the actuator member 610 and to the constricting disc 656.

Referring now to FIG. 34B, it can be seen that the constricting disc 656 has three holes 658*a*, 658*b*, and 658*c* formed therein. These holes 658 have a wide diameter portion 660 and a reduced diameter portion 662. As perhaps best shown in FIG. 34A, the wide diameter portion is sized and dimensioned to receive the straw 654 to form a pressure fit that mounts the disc 656 onto the straw 654 in a manner that prevents inadvertent removal of the disc 656 from the straw 654, but allows the disc 656 to be manually removed from the straw 654 when a different spray texture pattern is desired.

The reduced diameter portion 662 define an outlet portion 664 of a discharge passageway 666 defined by the outlet portion 652. As can be seen from FIG. 34B, each of the reduced diameter portions 662 has a different cross-sectional area, resulting in a different cross-sectional area of the outlet portion 664.

The embodiment of the present invention shown in FIGS. 34A and FIG. 34B thus allows the formation of different texture patterns as described in more detail above.

Figure 35:
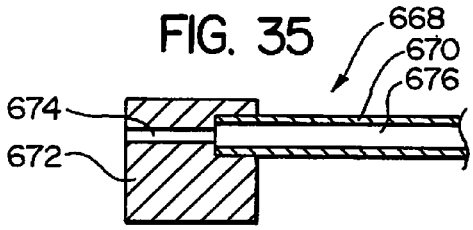
FIG. 35 is a section view showing yet another discharge assembly constructed in accordance with the present invention.

Referring now to FIG. 35, depicted therein is yet another outlet portion 668 constructed in accordance with, and embodying, the principles of the present invention. This outlet portion 668 is similar to the portion 652 described above. The outlet portion 668 comprises a straw 670 that can be the same as the straw 654 described above and a constricting cylinder 672. The constricting cylinder 672 is in many respects similar to the constricting disc 656 described above; the cylinder 672 has three holes formed therein, each having a large diameter portion adapted to form a pressure fit with the straw 670 and a reduced diameter portion for allowing a cross-sectional area of an outlet portion 674 of an exit passageway 676 to be selected. The primary difference between the cylinder 672 and the disc 656 is that the outlet portion 674 of the exit passageway 676 is elongated.

Figure 36A:
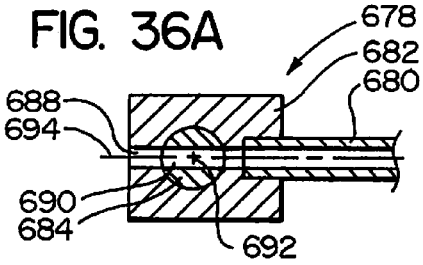
FIGS. 36A and 36B are section views showing yet another exemplary embodiment of a discharge assembly constructed in accordance with the principles of the present invention.
Figure 36B:
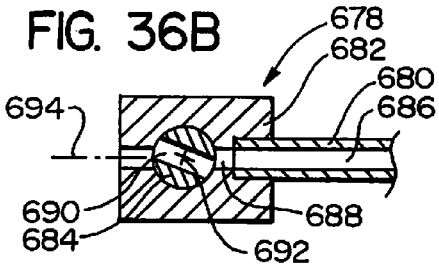

Referring now to FIGS. 36A and 36B, depicted therein is yet another exemplary embodiment of the present invention. In particular, FIGS. 36A and 36B depict yet another exemplary outlet assembly 678 adapted to be mounted onto an aerosol assembly such as the aerosol assembly 602 described above.

The outlet assembly 678 comprises a straw 680, a fixed member 682, and a movable member 684. The exit portion 678 defines a discharge passageway 686 that extends through the straw 680 and is defined by a first bore 688 defined by the fixed member 682 and a second bore 690 defined by the movable member 684.

The fixed member 682 is mounted onto the end of the straw 680 using a pressure fit established in a manner similar to that formed between the cylindrical member 672 and straw 670 described above. The movable member 684 is mounted within the fixed member 682 such that the movable member 684 may be rotated about an axis 692 transverse to a dispensing axis 694 defined by the discharge passageway 686.

As shown by a comparison of FIGS. 36A and 36B, rotation of the movable member 684 relative to the fixed member 682 can alter an effective cross-sectional area of the discharge passageway 686. By altering the discharge passageway in this manner, different texture patterns may be formed by the texture material being discharged through the discharge passageway 686. Rather than providing a plurality of discrete cross-sectional areas, the outlet portion 678 allows a continuous variation in the size of the cross-sectional area of the exit passageway 686. It should be noted that the discharge passageway 686 may be closed.

Figure 37A:
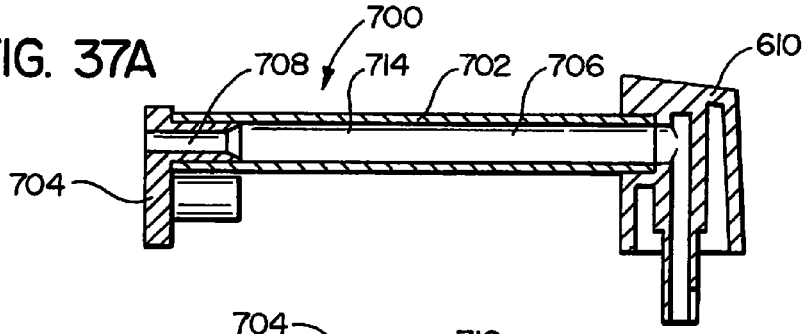
FIG. 37A is a section view showing still another exemplary discharge assembly constructed in accordance with the present invention.
Figure 37B:
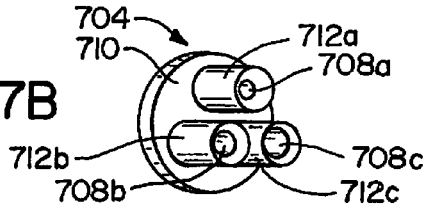
FIG. 37B is a perspective view showing one member of the assembly shown in FIG. 37A.

Referring now to FIGS. 37A and 37B, depicted therein is yet another example of a device incorporating the principles of the present invention. In particular, depicted in FIG. 37A is yet another discharge assembly 700 adapted to be mounted onto the actuator member 610 of the aerosol assembly 602.

The discharge assembly 700 comprises a straw 702 and a plug disc 704. The outlet portion 700 includes a discharge passageway 706 defined in part by the straw 702 and in part by one of a plurality of bores 708 formed in the plug disc 704. In particular, as shown in FIG. 37B the plug disc 704 comprises a disc portion 710 and three plug portions 712*a*, 712*b*, and 712*c*. The bores 708 extend through the plug portions 712. The plug portions 712 extend into a bore 714 defined by the straw 702 and form a pressure fit with the straw 702 that prevents inadvertent removal of the plug disc 704 from the straw 702 but allow the plug disc 704 to be manually removed when different spray texture patterns are desired.

Figure 38A:
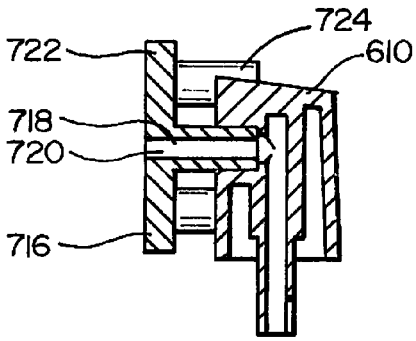
FIG. 38A is a section view of yet another exemplary discharge assembly.
Figure 38B:
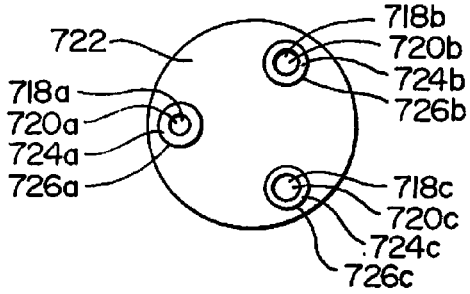
FIG. 38B is a front view of one of the components of the discharge assembly shown in FIG. 38A.

Referring now to FIGS. 38A and 38B, depicted therein is yet another device embodying the principles of the present invention. In particular, shown therein is an outlet member 716 adapted to be substituted for the outlet assembly 704 described above. The outlet member 716 is similar in construction and operation to the plug disc 704 described above. But the outlet member 716 is adapted to connect directly onto the actuator member 610 of the aerosol portion 602. The system shown in FIGS. 38A and 38B thus does not include a straw; a plurality of discharge passageways 718 are entirely formed by bores 720 formed in the discharge member 716.

As shown in FIG. 38B, the cross-sectional area of these bores 720*a*, 720*b*, and 720*c* are different, resulting in discharge passageways 718*a*, 718*b*, and 718*c* having different cross-sectional areas.

The discharge member 716 comprises a plate portion 722 and a plurality of plug portions 724 extending therefrom. The bores 720 extend through the plugs 724, and outer surfaces 726 of the plugs are adapted to fit within the actuator member 610 such that texture material leaving the aerosol portion 602 passes through the discharge passageway 718 defined by one of the bores 720. A selected one of the plugs 724 is inserted into the actuator member 610 depending on the texture pattern desired.

The embodiment shown in FIGS. 38A and 38B discloses a simple method of obtaining a plurality of texture patterns and includes a somewhat elongated discharge passageway.

Figure 39A:
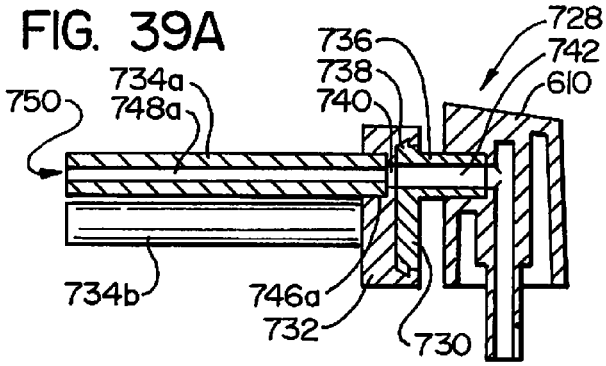
FIG. 39A is a section view showing yet another exemplary discharge assembly constructed in accordance with the present invention.
Figure 39B:
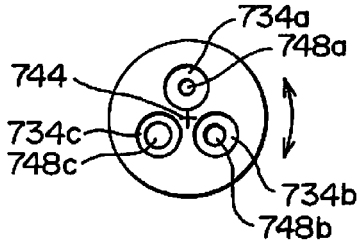
FIG. 39B is a front view showing one component of the discharge assembly shown in FIG. 39A.

Referring now to FIGS. 39A and 39B, depicted therein is yet another outlet assembly 728 adapted to be mounted onto the actuator member 610 of the aerosol device 602.

The outlet assembly 728 comprises a fixed member 730, a rotatable member 732, and a plurality of straws 734. The fixed member 730 has a plug portion 736 adapted to form a pressure fit with the actuator member 610 and a plate portion 738. The rotatable member 732 comprises a cavity adapted to mate with the plate portion 738 of the fixed member 730 such that a plurality of bores 740 in the movable member 732 may be brought into alignment with a bore 742 formed in the plug portion 736. This is accomplished by rotating the movable member 732 about an axis 744 relative to the fixed member 730. Detents or other registration means can be provided to positively lock the movable member 732 relative to the fixed member 730 when the bores 740 are in alignment with the bore 742.

Each of the bores 740 has an increased diameter portion 746 sized and dimensioned to receive one of the straws 734. Each of the straws 734 has an internal bore 748.

Texture material exiting the aerosol device 602 passes through a discharge passageway 750 formed by the bores 742, 740, and 748. Additionally, as perhaps best shown by FIG. 39B, each of the bores 748*a*, 748*b*, and 748*c* defined by the straws 734*a*, 734*b*, and 734*c* has a different bore cross-sectional area. Accordingly, by rotating the movable member 732 relative to the fixed member 730, a different one of the bores 748*a*, 748*b*, and 748*c* can be arranged to form a part of the discharge passageway 750. Thus, the outlet portion 728 allows the use of a plurality of straws, but does not require any of these straws to be removed and stored while one of the straws is in use.

The outlet portion 728 otherwise allows the selection of one of a plurality of texture patterns and does so using an elongate discharge passageway to provide the benefits described above.

Figure 40:
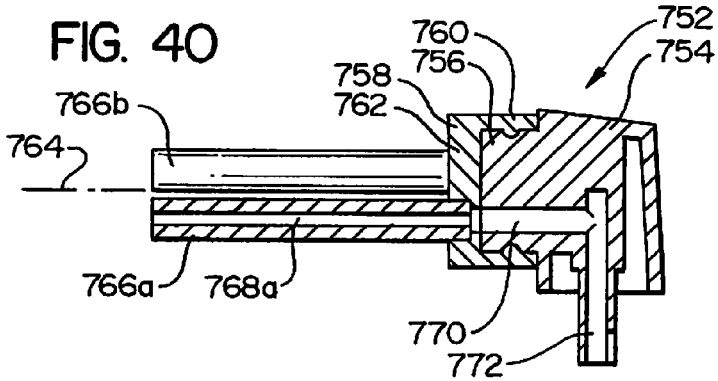
FIG. 40 is a section view of yet another exemplary discharge assembly constructed in accordance with the present invention.

Referring now to FIG. 40, depicted therein is yet another exemplary discharge assembly 752 constructed in accordance with, and embodying the principles of the present invention. The discharge assembly 752 is adapted to be mounted on a modified actuator member 754. The actuator member 754 is similar to the actuator member 610 described above except that the member 754 comprises a cylindrical projection 756 formed thereon. The cylindrical projection 756 functions in a manner substantially similar to the fixed member 730 described above, but is integrally formed with the actuator member 754 to eliminate one part from the overall assembly. The discharge portion 752 comprises a cap 758 having a hollow cylindrical portion 760 and a plate portion 762. The cylindrical portion 760 is adapted to mate with the cylindrical portion 756 such that the cap 758 rotates about an axis 764 relative to the actuator member 754. Extending from the plate portion 762 is a plurality of straws 766.

By rotating the cap 758 about the axis 764, bores 768 of the straws 766 may be brought into registration with a portion 770 of an exit passageway 772. The portion 770 of the exit passageway 772 extends through the cylindrical portion 756.

Additionally, each of the bores 768 has a different cross-sectional area. A desired texture pattern may be selected by placing one of the straws 768 in registration with the passageway portion 770. The overall effect is somewhat similar to that of the discharge portion 728. While the discharge portion 752 eliminates one part as compared to the discharge portion 728, the discharge portion 752 requires a specially made actuator member. In contrast, the discharge portion 728 uses a standard actuator member.

Figure 41:
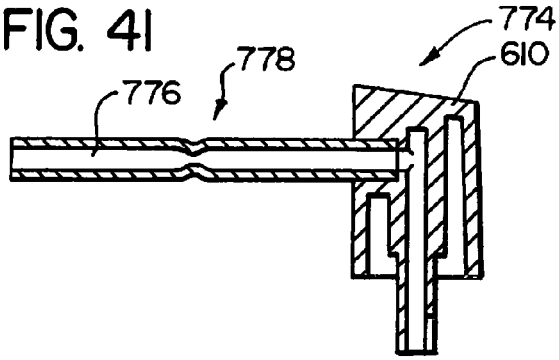
FIG. 41 depicts a discharge member constructed in accordance with the present invention.

Referring now to FIG. 41, depicted therein is yet another discharge member 774 adapted to be mounted on the actuator member 610. This system shown in FIG. 42 is very similar to the system described above with reference to FIGS. 1-18 in that, normally, a plurality of discharge members 774 will be sold with the aerosol portion 602, each straw corresponding to a different texture pattern.

But with the discharge members or straws 774, a bore 776 of each of the straws 774 will have the same cross-sectional area except at one location identified by reference character 778 in FIG. 41. At this location 778, the straw 774 is pinched or otherwise deformed such that, at that location 778, the cross-sectional area of the bore 776 is different for each of the straws. While the location 778 is shown approximately at the middle of the straw 774, this location may be moved out towards the distal end of the straw 774 to obtain an effect similar to that shown and described in relation to FIG. 31B.

The system shown in FIG. 41 allows the manufacturer of the device to purchase one single size of straw and modify the standard straws to obtain straws that yield desirable texture patterns. This configuration may also be incorporated in a product where the end user forms the deformion 778 to match a preexisting pattern.

Figure 42A:
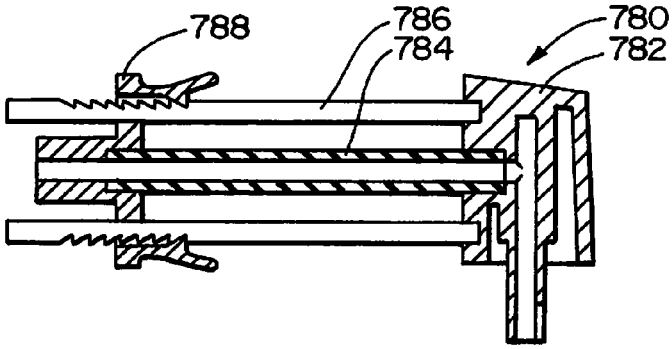
FIGS. 42A and 42B are section views showing the details of construction and operation of yet another exemplary discharge assembly.
Figure 42B:
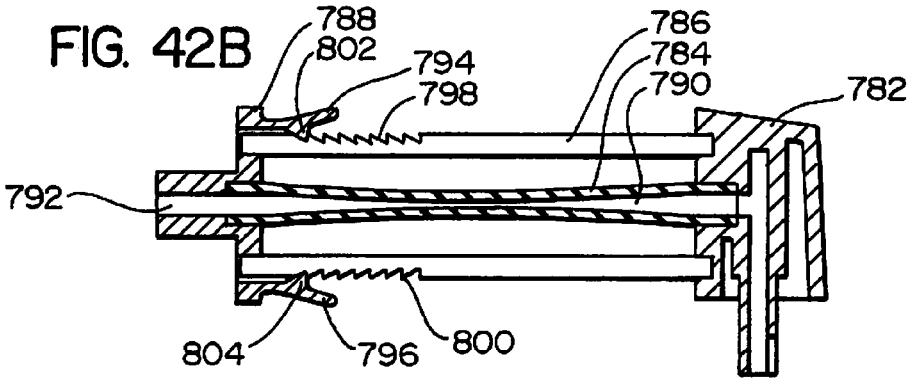

Referring now to FIGS. 42A and 42B, depicted therein is yet another discharge assembly 780 adapted to be mounted on an actuator member 782 that is substituted for the actuator member 610 described above.

The discharge assembly 780 comprises a flexible straw 784, a rigid hollow cylinder 786, and a tensioning plate 788. The straw 784 is securely attached at one end to the actuator member 782 and at its distal end to the tensioning plate 788. A central bore 790 defined by the straw 784 is in communication with a bore 792 formed in the tensioning plate 788. Thus, texture material flowing out of the aerosol portion 602 passes through the bores 790 and 792, at which point it is deposited on the surface being coated.

The outer cylinder 786 is mounted onto the actuator member 782 such that it spaces the tensioning plate 788 in one of a plurality of fixed distances from the actuator member 782. More specifically, extending from the tensioning plate 788 are first and second tabs 794 and 796. Formed on the cylinder 786 are rows of teeth 798 and 800. Engaging portions 802 and 804 on the tabs 794 and 796 are adapted to engage the teeth 798 and 800 to hold the tensioning plate 788 at one of the plurality of locations along the cylinder 786.

As the tensioning plate moves away from the actuator member 782 (compare FIGS. 42A and 42B), the resilient straw 784 becomes stretched, thereby decreasing the cross-sectional area of the bore 790 formed therein. By lifting on the tab 794 and 796, the engaging portions 802 and 804 can be disengaged from the teeth 798 and 800 to allow the tensioning plate 788 to move back towards the actuator member 782. By this process, the cross-sectional area of the bore 790 defined by the flexible straw 784 can be varied to obtain various desired texture patterns.

Figure 43A:
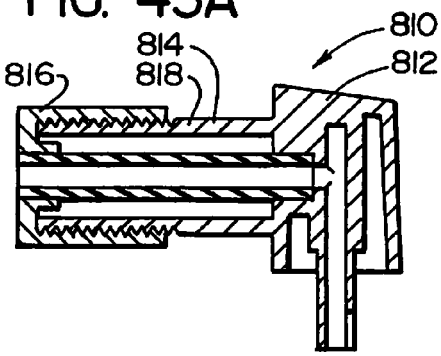
FIGS. 43A and 43B are section views showing the construction and operation of a discharge assembly constructed in accordance with the principles of the present invention.
Figure 43B:
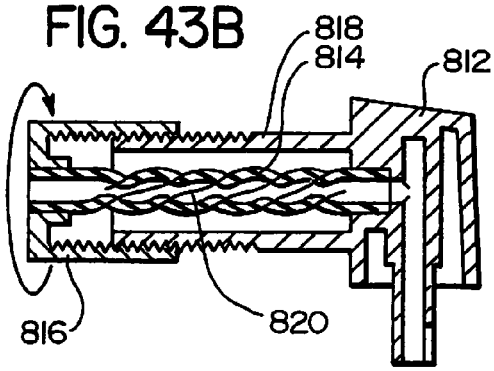

Referring now to FIGS. 43A and 43B, depicted therein is an output assembly 810 adapted to be mounted on an actuator member 812. The actuator member 812 functions in the same basic manner as the actuator member 610 described above but has been adapted to allow the discharge assembly 810 to be mounted thereon.

In particular, the discharge portion 810 comprises a straw 814 and a tensioning cylinder 816. The straw 814 is flexible and is connected at one end to the actuator member 812 and a distal end to the tensioning cylinder 816. The tensioning cylinder 816 is threaded to mount on a spacing cylinder 818 integrally formed with the actuator member 812.

When the tensioning cylinder 816 is rotated about its longitudinal axis, the threads thereon engage the threads on the spacing cylinder 818 to cause the tensioning cylinder 816 to move towards and away from the actuator member 812. Additionally, as the ends of the straw 814 are securely attached to the actuator member and the tensioning cylinder, rotation of the tensioning cylinder 816 causes the straw 814 to twist as shown in FIG. 43B. This twisting reduces the cross-sectional area of a central bore 820 defined by the straw 814 and thus allows texture material passing through this bore 820 to be applied in different texture patterns.

Figure 44:
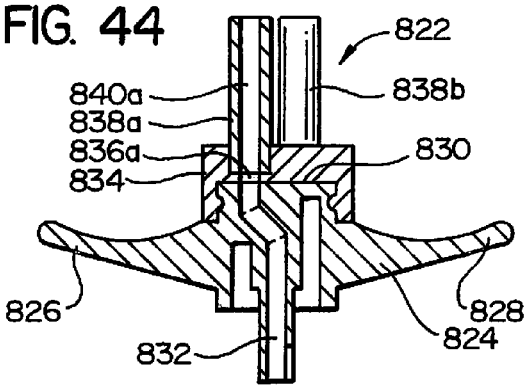

Referring now to FIG. 44, depicted therein is yet another exemplary discharge assembly 822. This discharge portion 822 is adapted to be mounted on an actuator member 824. The actuator member 824 performs the same basic functions as the actuator member 610 described above but has been adapted to direct fluid passing therethrough upwardly rather than laterally. To facilitate this, the actuator member 824 comprises first and second gripping portions 826 and 828 sized and dimensioned to allow the user to pull down on the actuator member 824 while holding the aerosol portion 602 in an upright position. The actuator member 824 further comprises an upper surface 830. An exit passageway 832 at least partially defined by the actuator member 824 terminates at the upper surface 830.

The discharge assembly 822 comprises a mounting cap 834 adapted to be attached to the actuator member 824 such that a plurality of bores 836 in the cap 834 can be brought into registration with the exit passageway 832. Mounted on the mounting cap 834 are a plurality of straws 838 having central bores 840 of different cross-sectional areas. These straws 838 are mounted onto the mounting cap 834 such that the bores 840 are in communication with a corresponding one of the bores 836 formed in the mounting cap 834. By rotating the mounting cap 834 relative to the actuator member 824, one of the central bores 840 is brought into registration with the exit passageway portion 832 such that texture material passing through the exit passageway 832 exits the system through the aligned central bore 840. Each of the straws 838 thus corresponds to a different texture pattern, and the desired texture pattern may be selected by aligning an appropriate central bore 840 with the exit passageway 832.

The system shown in FIG. 44 is particularly suited for the application of texture material in a desired pattern onto a ceiling surface or the like.

Figure 45:
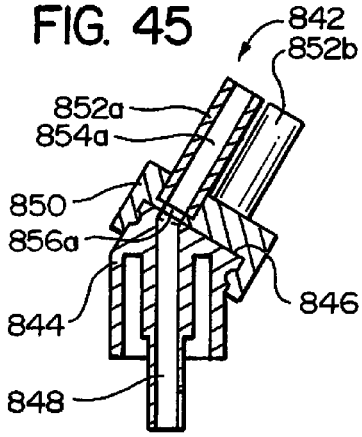

Referring now to FIG. 45, depicted therein is an output portion 842 designed to apply texture material at an angle between vertical and horizontal. This discharge portion 842 is adapted to be mounted on an actuator member 844. The actuator member 844 functions in a manner similar to the actuator member 824 described above. In particular, the actuator member has a canted surface 846 that is angled with respect to both horizontal and vertical. An exit passageway 848 defined by the actuator member 844 terminates at the canted surface 846.

The discharge portion 842 comprises a mounting cap 850 and a plurality of straws 852 mounted on the cap 850. Each of these straws defines a center bore 854. The cross-sectional areas of the central bores 854 are all different and thus allowed the formation of different texture patterns.

The mounting cap 850 has a plurality of bores 856 formed therein, with each bore 856 having a corresponding straw 852. Additionally, the bores 856 are spaced from each other such that rotation of the mounting cap 850 relative to the actuator member 854 aligns one of the bores 856, and thus the central bore 854 of one of the straws 852 such that texture material exiting the aerosol portion 602 passes through a selected central bore 854 of one of the straws 852.

The system shown in FIG. 45 is particularly suited for applying texture material to an upper portion of a wall.

Figure 46:
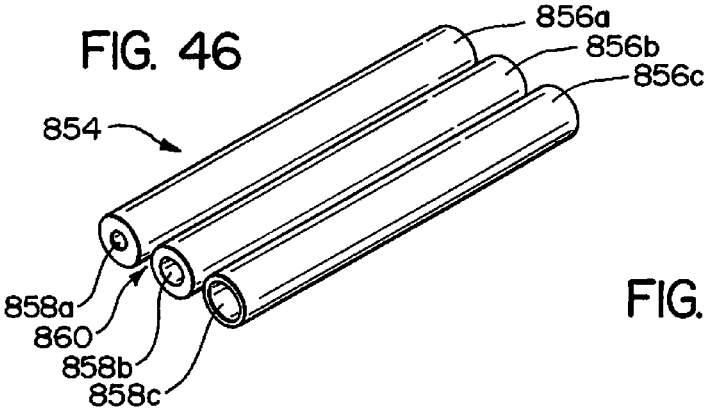
FIG. 46 is an isometric view showing yet another discharge assembly constructed in accordance with, and embodying, the principles of the present invention.

Referring now to FIG. 46, depicted therein is yet another exemplary output assembly 854 that may be mounted onto an actuator member such as the actuator member 610 recited above.

The actuator assembly 854 comprises three straw members 856 each having a central bore 858. These straw members 856 are joined together to form an integral unit, but are spaced from each other as shown at 860 in FIG. 46 to allow them to be mounted onto an actuator member such as the actuator member 610.

The cross-sectional areas of the bores 858*a*, 858*b*, and 858*c* are different, and different spray texture patterns may be obtained by inserting one of the straws into the actuator member such that texture material flows through central bore 858 associated therewith. In this context, it should be apparent that the output portion 854 is used in the same basic manner as the plurality of straws described in relation to FIGS. 1-18, but decreases the likelihood that unused straws will be lost when not in use.

Figure 47:
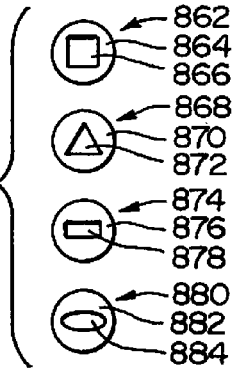
FIG. 47 is a front view showing a number of possible passageway configurations constructed in accordance with the principles of the present invention.

Referring now to FIG. 47, depicted therein are a plurality of central bore configurations that may be employed in place of the cylindrical configurations described above. For example, shown at 862 is a structure 864 defining a square central bore 866. This bore 866 may be square along its entire length or may be made square only at the end portion thereof to reduce the cross-sectional area through which the texture material must pass as it is dispensed.

Shown at 868 is yet another structure 870 defining a bore 872 having a triangular cross section. Shown at 874 is a structure 876 having a bore 878 configured in a rectangular shape. At 880 in FIG. 47 is shown yet another structure 882 that defines a bore 884 having an oval configuration.

Bores such as the bores 878 and 884 described above that are wider than they are tall may, in addition to defining a certain cross-sectional area, also create desirable spray characteristics such as a fan shape.

Figure 48:
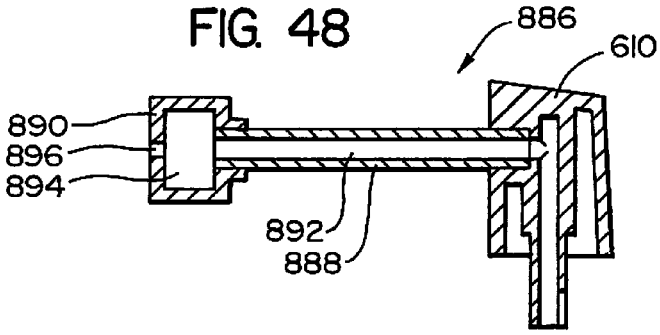
FIG. 48 is a section view of yet another discharge assembly constructed in accordance with the present invention.

Referring now to FIG. 48, depicted therein is yet another output portion 886 adapted to be mounted on the actuator member 610. The output portion 886 comprises a straw 888 and a box member 890. The straw 888 is connected at one end to the actuator member 610 such that texture material exiting the actuator member 610 passes through a central bore 892 defined by the straw 888. The box member 890 is attached to the distal end of the straw 888.

The box member 890 defines a chamber 894 through which texture material must pass before it passes through a discharge opening 896. The chamber 894 acts as a pressure accumulator that will smooth out any variations in pressure in the texture material as it is dispensed through the opening 896.

Figure 49:
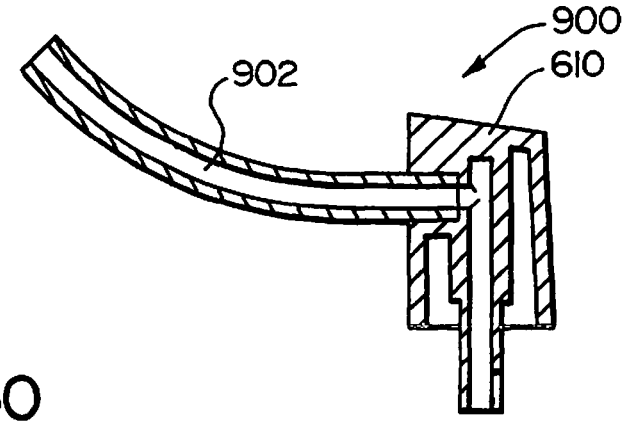
FIGS. 49 and 50 are section views of discharge members adapted to apply texture material to a wall region or a ceiling while still using a conventional discharge member.

Referring now to FIG. 49, there is a discharge member or straw 900 adapted to be mounted on the actuator member 610. The discharge straw 900 defines a central bore 902 through which texture material must pass as it exits the actuator member 610. The straw member 900 is curved such that the texture material leaving the bore 902 moves at an angle relative to both horizontal and vertical. From the discussion of the other embodiments above, it should be clear that a plurality of curved straws such as the straw 900 may be provided each having an internal bore with a different cross-sectional area. This would allow the texture material not only to be applied upwardly with the aerosol portion 602 being held upright but would allow different spray texture patterns to be applied.

Figure 50:
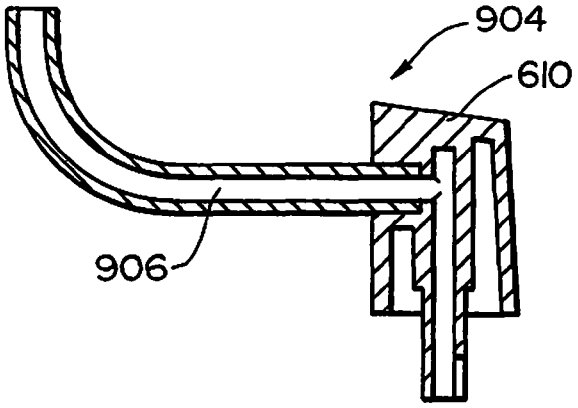

Referring now to FIG. 50, depicted at 904 therein is a discharge member or straw similar to the straw 900 described above. The difference between the straw 904 and the straw 900 is that the straw 904 is curved approximately 90° such that the texture material passing through a central bore 906 thereof is substantially parallel to vertical as it leaves the straw 904.

Figure 51:
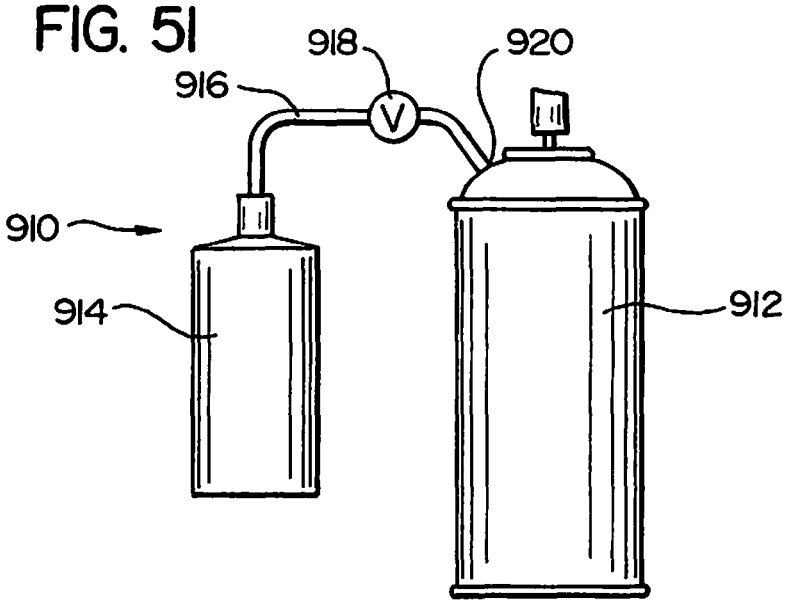
FIG. 51 depicts a somewhat schematic view showing an assembly comprising an aerosol container and a supplemental container adapted to maintain the pressure within the aerosol container at a desired level to provide a consistent texture pattern in accordance with the principles of the present invention.

Referring now to FIG. 51, depicted therein is an aerosol assembly 910 constructed in accordance with, and embodying, the principles of the present invention. This assembly 910 comprises a main aerosol container 912, a secondary container 914, a conduit 916 allowing fluid communication between the containers 912 and 914, and a valve 918 arranged to regulate the flow of fluid through the conduit 916.

The main container 912 is similar to a conventional aerosol container as described above except that it has an additional port 920 to which the conduit 916 is connected. The secondary container 914 is adapted to contain a pressurized fluid such as air or nitrogen. The pressurized fluid is preferably inert.

The compressed fluid within the secondary container 914 is allowed to enter the primary container 912 to force texture material out of the main container 912. The valve 918 controls the amount of pressure applied on the texture material by the compressed fluid within the secondary container 914.

Thus, rather than relying on an internally provided propellant gas to stay at a desired pressure associated with a consistent spray texture pattern, an external gas source is applied with a valve to ensure that the pressure remains at its desired level while the texture material is being dispensed.

Figure 52:
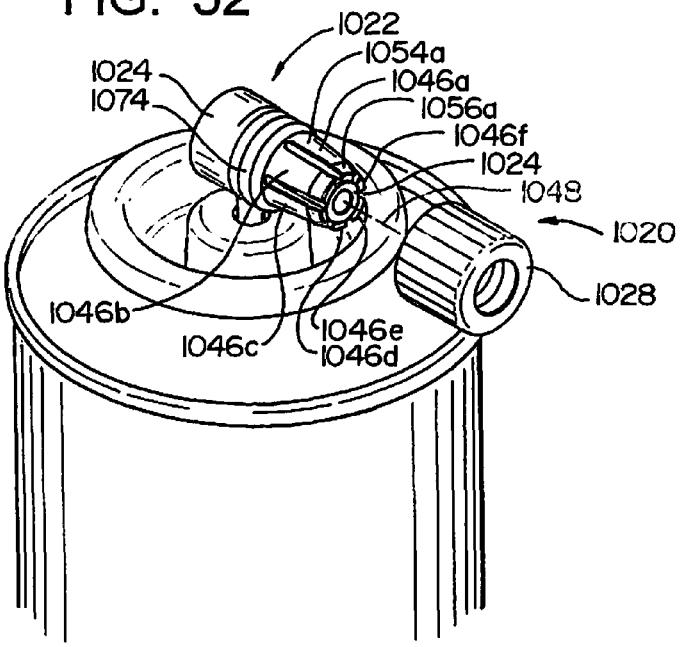
FIG. 52 is a perspective view of part of an aerosol texturing assembly employing an outlet assembly constructed in accordance with, and embodying, the principles of the present invention.

Referring now to FIG. 52, depicted at 1020 therein is an aerosol assembly for applying texture material onto a wall surface constructed in accordance with, and embodying, the principles of the present invention. The aerosol assembly 1020 and the texture material dispensed thereby are in most respects similar to other embodiments that have been described above and will be described herein only to the extent necessary for a complete understanding of the present invention.

The primary difference between the aerosol assembly 1020 and the other aerosol assemblies described above is the manner in which texture material leaves the assembly 1020. The aerosol assembly 1020 comprises an outlet assembly that can be adjusted to dispense texture material in a manner that allows the user to match existing texture patterns.

Figure 53:
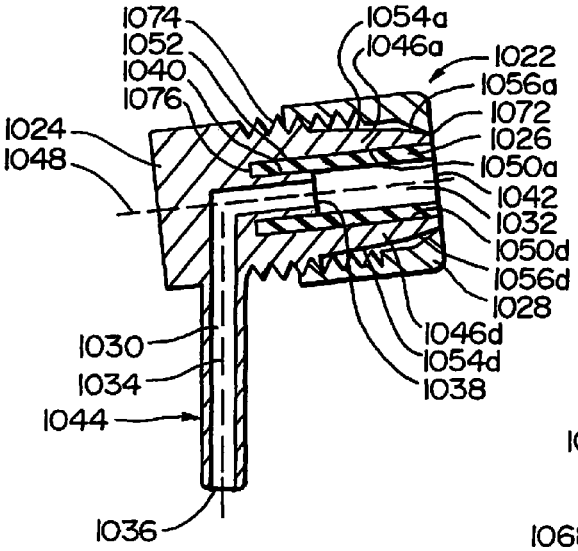
FIG. 53 is a section view of the outlet assembly used by the aerosol assembly of FIG. 52.

As perhaps best shown in FIG. 53, the outlet assembly 1022 comprises an actuator member 1024, and outlet member 1026, and an adjustment member 1028.

The actuator member 1024 defines an actuator passageway 1030, and the outlet member 1026 defines an outlet passageway 1032. The actuator passageway 1030 and the outlet passageway 1032 define a portion of a dispensing path 1034 through which texture material passes as it is dispensed from the aerosol assembly 1020. More specifically, the actuator passageway 1030 comprises an actuator inlet opening 1036 and an actuator outlet opening 1038. The outlet passageway 1032 similarly comprises an inlet portion 1040 and an outlet opening 1042. The outlet member 1026 is arranged relative to the actuator member 1024 such that the actuator outlet opening 1038 is arranged within the inlet portion 1040 of the outlet passageway 1032.

The actuator member 1024 comprises a stem portion 1044 that is received within the aerosol assembly 1020 such that texture material released from the aerosol assembly 1020 enters the actuator passageway 1030 through the actuator inlet opening 1036, exits this actuator passageway 1030 through the actuator outlet opening 1038 into the outlet passageway 1032, and then exits this outlet passageway 1032 through the outlet opening 1042.

With the basic flow of texture material through the outlet assembly 1022 in mind, the specific operation of this outlet assembly 1022 will now be described in more detail.

As discussed above and is now generally known in the art of applying texture material, the pattern formed by the texture material as it is deposited onto a wall can be changed by changing the effective cross-sectional area of the last opening through which the texture material passes as it exits the dispensing system. In the invention embodied in the aerosol assembly 1020, the texture material last passes through the outlet opening 1042 described above. The outlet assembly 1022 is configured to allow the cross-sectional area of the outlet opening 1042 to be altered simply by axially displacing the adjustment member 1028 relative to the actuator member 1024 and outlet member 1026.

In particular, the outlet member 1026 is formed of a resilient, compressible material such as natural or synthetic rubber. The exemplary outlet member 1026 is in the form of a hollow cylinder. The effective cross-sectional area of the outlet opening 1042 can thus be changed by deforming, or in this case squeezing, the outlet member 1026. The actuator member 1024 and adjustment member 1028 are designed to interact to deform or squeeze the outlet member 1026 and thereby decrease the effective cross-sectional area of the outlet opening 1042 from a predetermined initial configuration.

Referring back for a moment to FIG. 52, it can be seen that the actuator member 1024 comprises a plurality of actuator fingers 1046A-E that generally extend along a dispensing axis 1048 defined by the outlet member 1026. Two of these fingers, 1046A and 1046D, are shown in FIG. 53. FIG. 53 shows these fingers in an initial configuration in which inner wall 1050 of the finger 1046A is generally parallel to the dispensing axis 1048.

Figure 54:
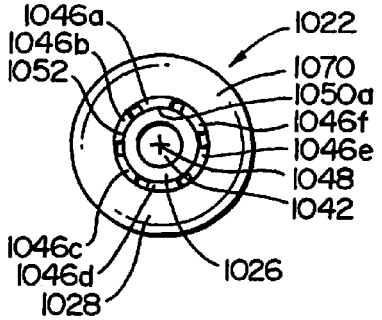
FIG. 54 is an end elevational view of the outlet assembly as shown in FIG. 53.

As shown in FIG. 54, these inner wall surfaces 1050 are generally arcuate and, together, define a cylinder of approximately the same dimensions as an outer surface 1052 of the outlet member 1026. FIG. 53 shows that the actuator fingers 1046 define outer surface portions 1054 and 1056. These outer surface portions 1054 and 1056 are also shown in FIG. 52.

The outer surface portions 1054 and 1056 of the actuator fingers 1046 are curved and slanted such that they together define a conical shape that is coaxially aligned with the dispensing axis 1048. More specifically, the outer surface portions 1054 define a conical surface that is at a first angle a with a respect to the dispensing axis 1048, while the outer surface portions 1056 define a conical shape that extends at a second angle 13 with a respect to the dispensing axis 1048.

Figure 53A:
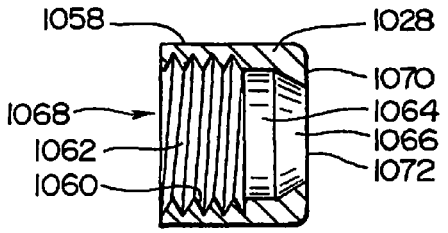
FIG. 53A is a section view of the adjustment member of the outlet assembly of FIG. 53

Referring now to FIG. 53A, depicted therein is a sectional view of the adjustment member 1028. The adjustment member 1028 comprises a generally cylindrical exterior wall 1058 and an interior wall 1060. This interior wall 1060 comprises a threaded portion 1062, a generally cylindrical portion 1064, and a frustaconical portion 1066. The interior wall 1060 defines an adjustment passageway 1068.

The adjustment member 1028 further defines an annular front surface 1070. An adjustment edge 1072 is defined at the juncture of the annular front surface 1070 and the frustaconical portion 1066 of the interior wall 1060.

Referring for a moment back to FIGS. 52 and 53, it can be seen that the actuator member 1024 has a threaded surface portion 1074 that is coaxially aligned with the dispensing axis 1048.

As is perhaps best shown by comparing FIGS. 53 and 54 with FIGS. 55 and 56, the cross-sectional area of the outlet opening 1042 can be changed as follows. Initially, the outlet member 1026 is attached to the actuator member 1024 with the longitudinal axis of the outlet member 1026 aligned with the dispensing axis 1048. In the exemplary outlet assembly 1022, the outlet member 1026 is received within a groove 1076 that extends into the actuator member 1024 in a direction opposite that of the acuator fingers 1046. Adhesives may be used to further secure the outlet member 1026 to the actuator member 1024.

With the outlet member 1026 so attached to the actuator member 1024, the actuator fingers 1046 extend along a substantial portion of the outlet member 1026 and overlap a substantial portion of the outer surface 1052 of the outlet member 1026.

The adjustment member 1028 is then attached to the actuator member 1024 by engaging the threaded surface portions 1062 and 1074 and rotating the adjustment member 1028 about the dispensing axis 1048. Further rotation of the adjustment member 1028 will displace this member relative to the actuator member 1024 such that the adjustment edge 1072 of the adjustment member 1028 engages the outer surfaces 1056 defined by the actuator fingers 1046.

Figure 55:
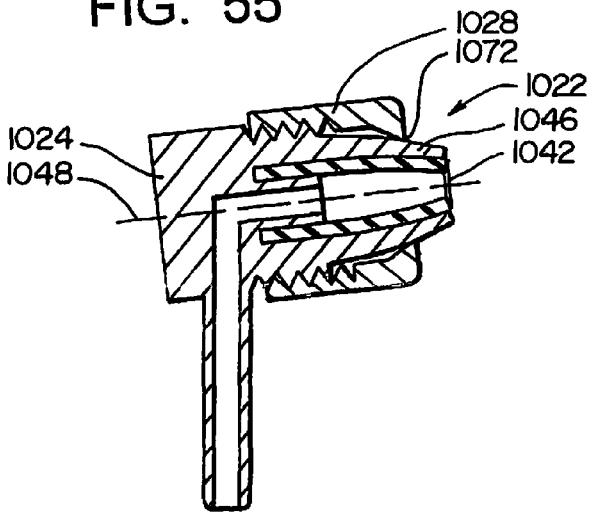
FIG. 55 is a section view of the outlet assembly of FIG. 52 in a narrowed down configuration.
Figure 56:
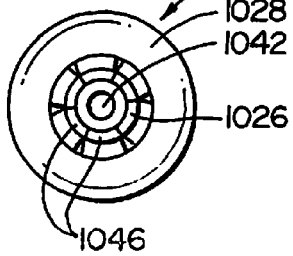
FIG. 56 is a front elevational view of the outlet assembly as shown in FIG. 55.

Rotating the adjustment member 1028 still further causes the adjustment edge 1072 to act on the outer surfaces 1056 such that, as shown in FIG. 55, the actuator fingers 1046 are deformed and moved from their original positions to one in which they are angled slightly towards the dispensing axis 1048. The actuator fingers 1046 in turn act on the outlet member 1026 to pinch the end thereof such that, as perhaps best shown by comparing FIGS. 54 and 56, the outlet opening 1042 has a substantially smaller cross-sectional area.

The outlet assembly 1022 is infinitely and continuously adjustable between the positions shown in FIGS. 53 and 55, but a system may be provided to direct the user to certain predetermined positions that correspond to common, standard, or preexisting texture patterns. For example, simply marking the outer surface of the actuator member 1024 and/or adjustment member 1028 may be enough to indicate at what point the relationship between the actuator member 1024 and adjustment member 1028 is such that a given texture pattern will be obtained. Another way to accomplish this is to provide projections and depressions on adjacent surfaces such that the actuator member 1024 positively snaps into place at desired locations. But even without means to indicate desired relative locations between the adjustment member 1028 and the actuator member 1024, the user may simply adjust and spray on a test surface several times until the texture pattern obtained by the aerosol assembly 1020 matches that of the preexisting pattern.

Figure 57:
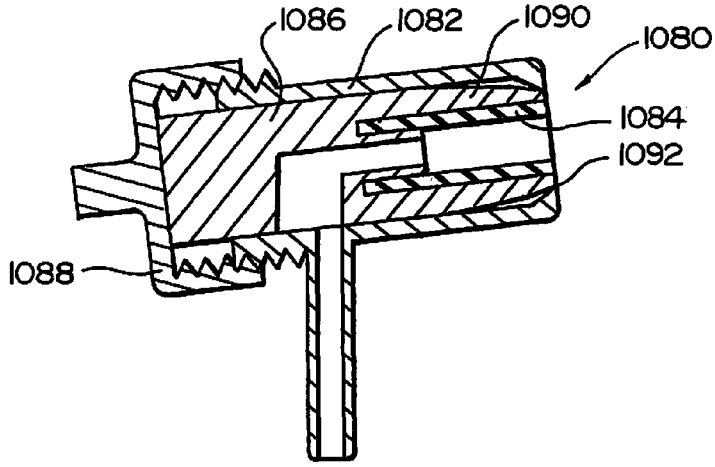
FIG. 57 is a sectional view of an alternate outlet assembly that may be used with the aerosol assembly shown in FIG. 52.
Figure 58:
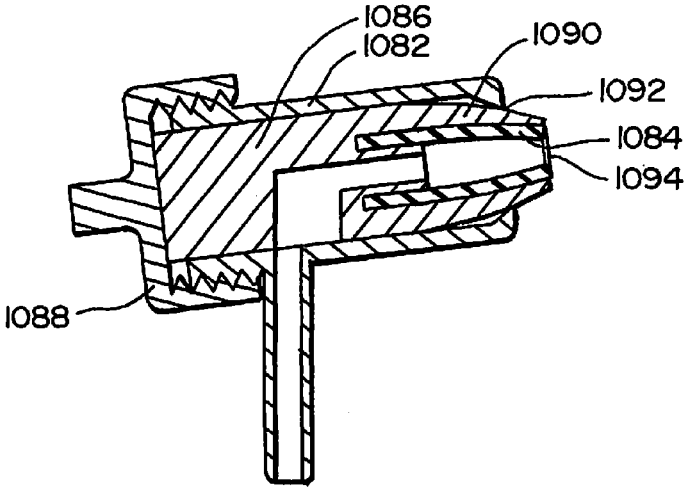
FIG. 58 is a sectional view depicting the outlet assembly of FIG. 57 in a narrowed down configuration.

Referring now to FIGS. 57 and 58, yet another exemplary outlet assembly is depicted at 1080 therein. The outlet assembly 1080 is used and operates in much the same way as the outlet assembly 1022 described above; the outlet assembly 1080 will thus be described herein only to the extent that it differs in construction from the outlet assembly 1022.

The outlet assembly 1080 comprises an actuator member 1082, an outlet member 1084, an adjustment block 1086, and an adjustment cap 1088. In this outlet assembly 1080, fingers 1090 that engage the outlet member 1084 in a manner similar to that of the actuator fingers 1046 described above are formed on the adjustment block 1086 rather than the actuator member 1082. The adjustment cap 1088 is threaded to engage the actuator member 1082 to displace the adjustment block 1086 relative to the actuator member 1082.

Accordingly, simply by rotating the adjustment cap 1088, the adjustment block 1086 is moved forward relative to the actuator member 1082. The actuator member 1082 defines an actuator edge 1092 that acts on the fingers 1090 to deform the outlet member 1084 and thus change a cross-sectional area of an outlet opening 1094 defined by the outlet member 1084.

Figure 59:
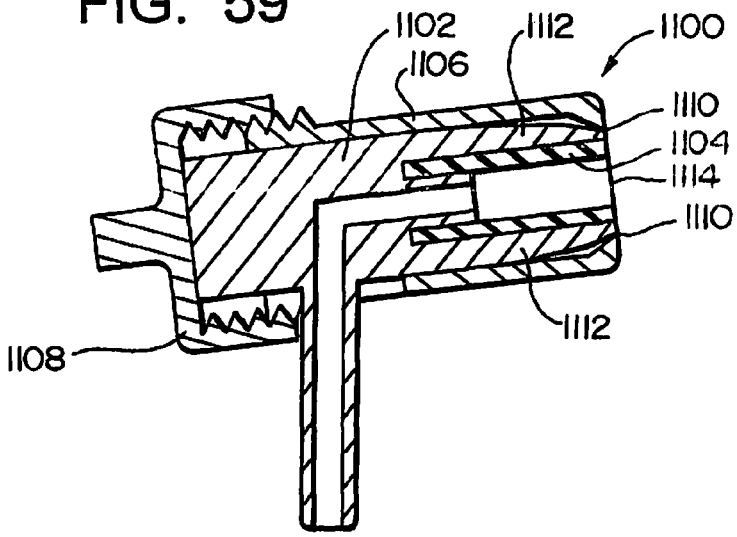
FIG. 59 is a sectional view of yet another outlet assembly that may be used with the aerosol assembly of FIG. 52.
Figure 60:
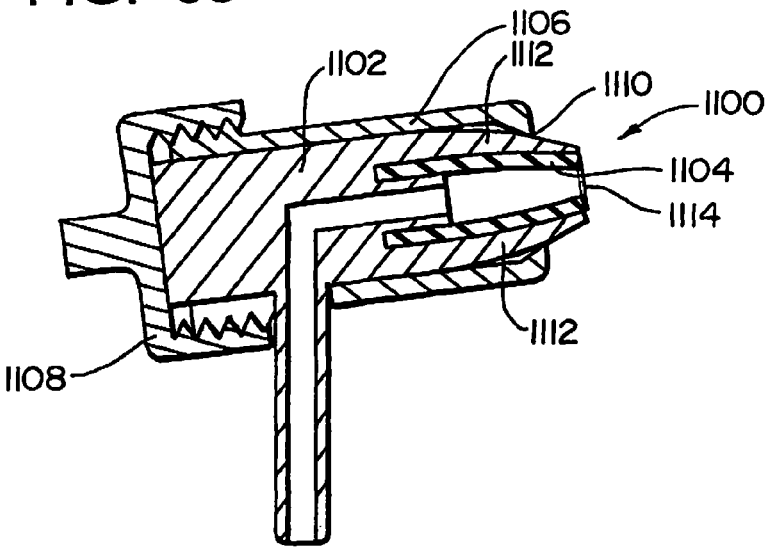
FIG. 60 is a sectional view depicting the outlet assembly of FIG. 59 in a narrowed down configuration.

Referring now to FIGS. 59 and 60, depicted therein is yet another exemplary outlet assembly 1100 that may be used in place of the outlet assembly 1022 described above. The outlet assembly 1100 comprises an actuator member 1102, an outlet member 1104, an adjustment sleeve 1106, and adjustment cap 1108. The actuator member 1102 is similar to the actuator member 1024 described above except that the actuator member 1102 is not threaded. Instead, the adjustment sleeve 1106 fits over the actuator member 1102 and engages the adjustment cap 1108 such that rotating the adjustment cap 1108 slides the adjustment sleeve 1106 from an initial configuration shown in FIG. 59 to a retracted configuration shown in FIG. 60.

The adjustment sleeve 1106 defines an adjustment edge 1110. The actuator member 1102 comprises a plurality of finger portions 1112. The outlet member 1104 terminates in an outlet opening 1114.

The adjustment edge 1110 engages the finger portions 1112 as the adjustment cap 1108 is rotated to move the adjustment sleeve 1106 between the positions shown in FIGS. 59 and 60. In particular, as the adjustment sleeve 1106 is pulled back towards the adjustment cap 1108 by the engagement of mating threaded portions on the members 1106 and 1108, the adjustment edge 1110 engages the finger portions 1112 and deforms the free ends of these finger portions 1112 towards each other. As shown by comparison of FIGS. 59 and 60, the movement of the fingers 1112 towards each other squeezes or deforms the end of the outlet member 1104. The cross-sectional area of the outlet opening 1114 defined by the outlet member 1104 is thus changed. As the adjustment edge 1110 moves relative to the finger portions 1112, the outlet opening 1114 passes the adjustment edge 1110.

The adjustment sleeve 1106 and adjustment cap 1108 thus form an adjustment assembly or means that acts on the actuator member 1102 to deform the outlet member 1104 and thus change the cross-sectional area of the outlet opening 1114.

Figure 61:
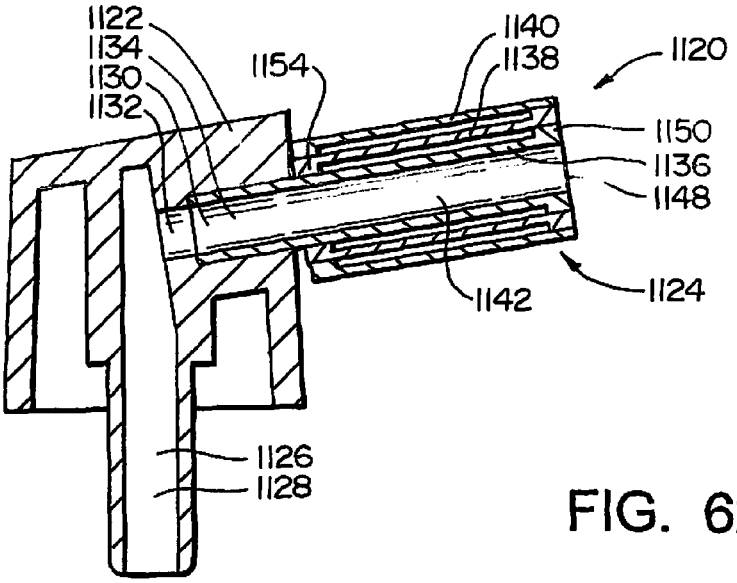
FIG. 61 is a sectional view of yet another outlet assembly that may be used with another aerosol assembly of FIG. 52, this outlet assembly being shown in a reduced diameter configuration in FIG. 61.
Figure 62:
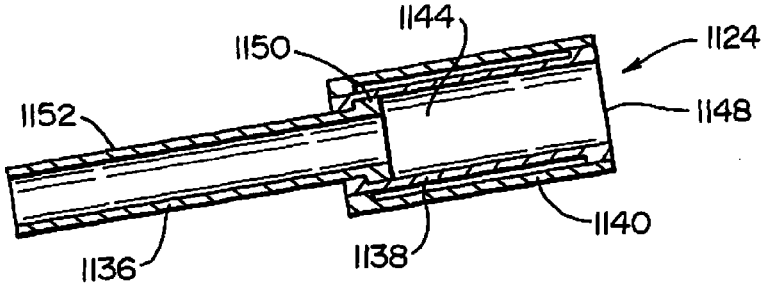
FIG. 62 is a sectional view showing a portion of the outlet assembly of FIG. 61 in a slightly increased diameter configuration.
Figure 63:
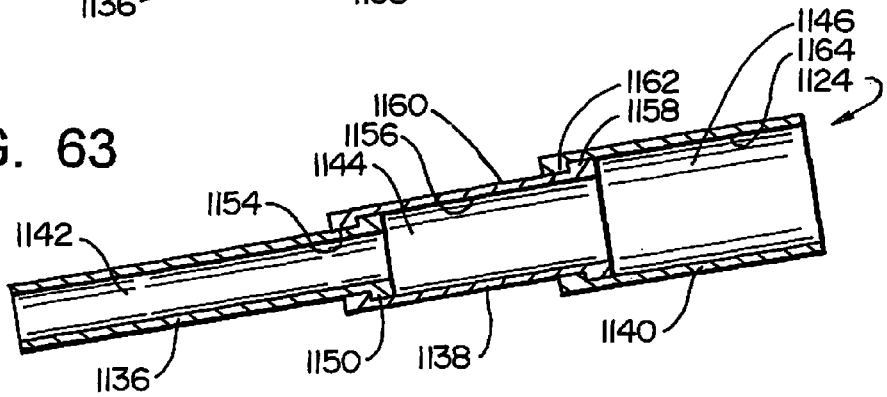
FIG. 63 is a sectional view of a portion of the outlet assembly of FIG. 61 in an enlarged cross-sectional area configuration.

Referring now to FIGS. 61 through 63, depicted therein at 1120 as yet another outlet assembly that may be used instead of the outlet assembly 1022 with the aerosol assembly 1020 described above.

The outlet assembly 1120 comprises an actuator member 1122 and an outlet assembly 1124.

The actuator member 1122 is or may be conventional. In this respect, it is noteworthy that the actuator member 1122 defines an actuator passageway 1126 having an inlet portion 1128 and an outlet portion 1130. The outlet portion 1130 comprises a reduced diameter portion 1132 and an increased diameter portion 1134. The increased diameter portion 1134 engages the outlet assembly 1124 as will be described in further detail below.

The outlet assembly 1124 comprises a first outlet member 1136, a second outlet member 1138, and a third outlet member 1140. As perhaps best shown in FIG. 63., the first outlet member 1136 defines a first outlet passageway 1142, the second outlet member 1138 defines a second outlet passageway 1144, and the third outlet member 1140 defines a third outlet passageway 1146.

A comparison of FIGS. 61, 62, and 63 illustrates that the outlet assembly 1124 can take any one of three major configurations. The first configuration is shown in FIG. 61, in which an outlet opening 1148 of the outlet assembly 1124 has a first predetermined cross-sectional area. In a second configuration shown in FIG. 62, the outlet opening 1148 has a second predetermined cross-sectional area. And in a third configuration shown in FIG. 63, the outlet opening 1148 has a third predetermined cross-sectional area.

The outlet opening 1148 is changed by telescoping the outlet members 1136, 1138 and 1140 relative to each other. More specifically, the first outlet member 1136 is somewhat longer than the outlet members 1138 and 1140. This extra length allows an end of the first outlet member 1136 to be inserted into the increased diameter portion 1134 of the outlet portion 1130 of the actuator passageway 1126. A friction fit is formed between the first outlet member 1136 and the actuator member 1122 to affix the outlet assembly 1124 relative to the actuator member 1122. Adhesives may also be employed to strengthen the attachment of the outlet assembly 1124 to the actuator member 1122.

As shown in FIG. 61, in the first configuration the first outlet member 1136 is substantially within the second outlet passageway 1144 defined by the second outlet member 1138 and the second outlet member 1138 is within the third outlet passageway 1146 defined by the third outlet member 1148.

To place the outlet assembly 1124 into the second configuration, the second and third outlet members are displaced away from the actuator member 1122 such that the first outlet member 1136 is substantially withdrawn from the second outlet passageway 1144.

To prevent the second and third outlet members 1138 and 1140 from sliding completely off the first outlet member 1136, a plurality of stop rings are formed on these outlet members 1136, 1138 and 1140. In particular, a first stop ring 1150 is formed on an outer surface 1152 of the first outlet member 1136. A second stop ring 1154 is formed on an inner surface 1156 defined by the second outlet member 1138. A third stop ring 1158 is formed on an outer surface 1160 of the second outlet member 1138. And finally, a fourth stop ring 1162 is formed on an inner surface 1164 of the third outlet member 1140.

In the exemplary outlet assembly 1124, the outlet members 1136, 1138, and 1140 are generally cylindrical. The diameters of the surfaces 1152, 1156, 1160, and 1164 as well as the stop rings 1150, 1154, 1158, and 1162 are determined such that the various outlet members 1136, 1138, and 1140 may slide relative to each other until the stop rings engage each other to prevent further relative movement in a given direction. In particular, the first stop ring 1150 engages the second stop ring 1154 when the outlet assembly 1124 is in its second configuration. When the outlet assembly 1124 is in its third configuration, the first and second stop rings 1150 and 1154 engage each other as do the third and fourth stop rings 1158 and 1162.

As is shown by a comparison of FIGS. 61, 62, and 63, the point at which the texture material leaves the outlet assembly 1120, identified as the outlet opening 1148, is defined in the first configuration by the first outlet member 1136, in the second configuration by the second outlet member 1138, and in the third configuration by the third outlet member 1140. In the first configuration, the texture material simply passes directly through the first outlet passageway 1142 and out of the outlet assembly 1120.

In the second configuration, the texture material flows through the narrower first outlet passageway 1142 and then into the wider second outlet passageway 1144 and then through the outlet opening 1148. This larger outlet passageway 1144 allows the texture material to form into larger discreet portions and thus form a rougher texture pattern than in the first configuration.

In the third configuration the texture material passes through the first and second outlet passageways 1142 and 1144 and then the third outlet passageway 1146. Again, this third outlet passageway 1146 allows the texture material to form even larger portions which create an even rougher texture pattern than that created by the outlet assembly 1120 in its second configuration. The result is that three different texture patterns may be formed using the outlet assembly 1120.

Referring now to FIGS. 64-67, depicted therein is yet another exemplary outlet assembly that may be used with the aerosol assembly 1120 described above in place of the outlet assembly 1124. The outlet assembly 1170 comprises an actuator member 1172, an outlet member 1174, and an adjustment assembly 1176. The outlet assembly 1170 allows the cross-sectional area of an outlet opening 1178 defined by the outlet member 1174 to be varied.

Figure 66:
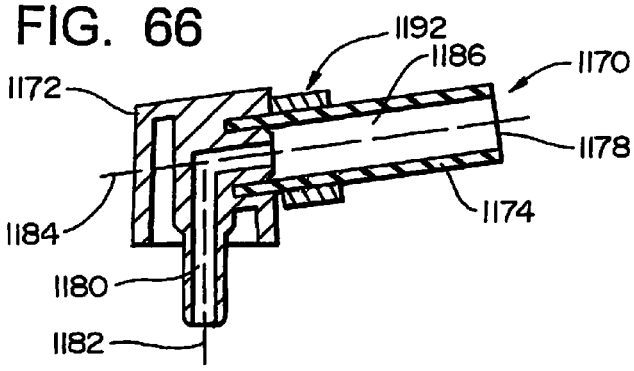
FIG. 66 is a sectional view showing the outlet assembly of FIG. 64 in its enlarged diameter configuration.

In particular, as shown in FIG. 66, the actuator member 1172 is generally conventional in that it defines an actuator passageway 1180 that forms part of a dispensing path 1182 along which texture material traverses as it is dispensed from the aerosol assembly. The texture material exits the outlet assembly 1170 along a dispensing axis 1184; the dispensing axis 1184 is aligned with a portion of the dispensing path 1182.

Figure 64:
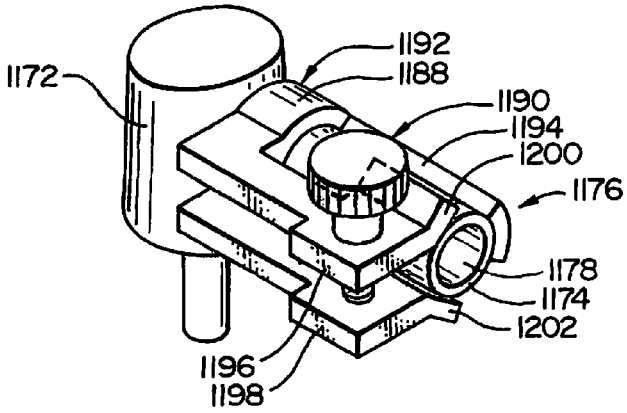
FIG. 64 is a perspective view of yet another outlet assembly that may be used in connection with the aerosol assembly of FIG. 52.
Figure 65:
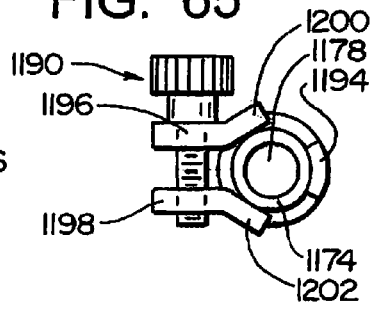
FIG. 65 is an end elevational view showing an enlarge diameter configuration of the assembly of FIG. 64.

The outlet member 1174 defines an outlet passageway 1186; in the exemplary outlet assembly 1170, the outlet member 1174 is a cylindrical member made of resilient material. When undeformed, the outlet passageway 1186 is also cylindrical and defines an outlet opening 1178. The undeformed configuration is shown in FIGS. 64, 65 and 66.

Operation of the adjustment assembly 1176 acts on the outlet member 1174 to deform this outlet member 1174 and thereby change the shape of the outlet passageway 1186 and thus the outlet opening 1178. In particular, the adjustment assembly 1176 comprises a clamp member 1188 and a screw member 1190.

The clamp member 1188 comprises a base portion 1192 from which extends a bracing finger 1194 and first and second clamping fingers 1196 and 1198. The clamp member 1188 may be formed from a material such as plastic that is resilient and thus may be deformed from an original configuration but which tends to spring back to its original configuration. Alternatively, the clamp member 1188 may be formed of a non-springy material and provided with a compression spring that forces the clamping fingers 1196 and 1198 apart.

The clamp fingers 1196 and 1198 define clamp portions 1200 and 1202. These clamp portions 1200 and 1202 are angled with respect to each other so that, when they engage the outlet member 1174, they push the outlet member 1174 against the bracing finger 1194.

Figure 67:
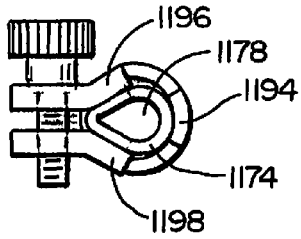
FIG. 67 is an end elevational view showing the outlet assembly of FIG. 64 in a reduced outlet area configuration.

The clamp fingers 1196 and 1198 are sufficiently resilient that they may be forced together as shown by comparing FIGS. 65 and 67. When they are forced together as shown, the outlet member 1174 is deformed such that the shape and/or cross-sectional area of the outlet opening 1178 is changed. Changing this outlet opening 1178, in shape and/or in size, changes the spray pattern in the texture material is applied and thus allows the user to match a preexisting texture pattern.

To facilitate the pinching together of the clamp fingers 1196 and 1198, the screw member 1190 is passed through the clamp finger 1196 and threaded into the clamp member 1198. Turning the screw member 1190 in one direction pulls the clamp fingers 1196 and 1198 towards each other, while turning the screw member 1190 in the other direction allows these clamp fingers 1196 and 1198 to move away from each other. Alternatively, the screw member 1190 may pass through both of the clamp fingers 1196 and 1198 and be threaded into a nut such that rotation of the screw member 1190 relative to the nut moves the clamp fingers 1196 and 1198.

Figure 68:
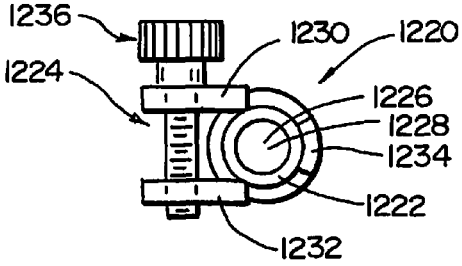
FIG. 68 is an end elevational view of another outlet assembly similar to that of FIG. 64, with FIG. 68 depicting the outlet assembly in its increased diameter configuration.
Figure 69:
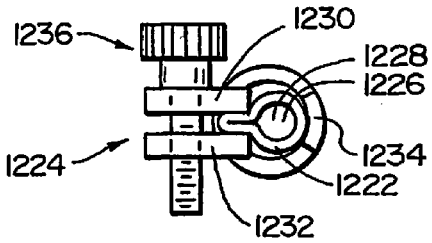
FIG. 69 is an end elevational view of the outlet assembly of FIG. 68 in a reduced outlet area configuration.

Referring now to FIGS. 68 and 69 depicted therein is a portion of yet another exemplary outlet assembly 1220 embodying the principles of the present invention. The outlet assembly 1220 includes an actuator member (not shown) and operates in a manner similar to that of the outlet assembly 1170 described above.

The outlet assembly 1220 comprises an actuator member (not shown in FIGS. 68 and 69), an outlet member 1222, and an adjustment assembly 1224. The outlet assembly 1220 allows the cross-sectional area of an outlet opening 1226 defined by the outlet member 1222 to be varied as shown by a comparison of FIGS. 68 and 69.

In particular, the exemplary outlet member 1222 is a cylindrical member that is made of resilient, deformable material. When the outlet member 1222 is undeformed, the outlet member 1222 defines a cylindrical outlet passageway 1228 which terminates at the outlet opening 1226. The undeformed configuration is shown in FIG. 68.

Operation of the adjustment assembly 1224 deforms the outlet member 1222 to change the shape of the outlet passageway 1228 and thus the outlet opening 1226. In particular, the adjustment assembly 1224 comprises first and second clamp fingers 1230 and 1232, a brace finger 1234, and a screw member 1236. The brace finger 1234 is fixed and braces a portion of the outlet member 1222. The clamp fingers 1230 and 1232 move relative to the outlet member 1222 to pinch a portion of the outlet member 1222 that is opposite the portion braced by the brace finger 1234. In particular, the screw member 1236 is threaded through the clamp fingers 1230 and 1232 such that axial rotation of the screw member 1236 cause the clamp fingers 1230 and 1232 to move relative to each other.

The adjustment assembly 1224 thus allows the cross-sectional area of the outlet opening 1226 to be changed to adjust the spray pattern of the texture material passing through the outlet passageway 1228.

Figure 70:
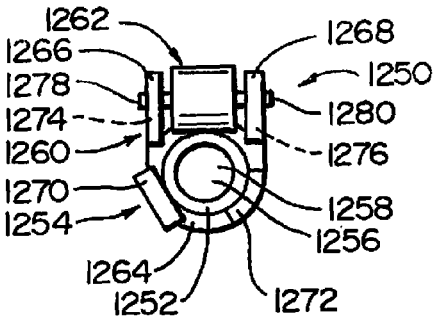
FIG. 70 is an end elevational view of yet another outlet assembly in its increased diameter configuration.
Figure 71:
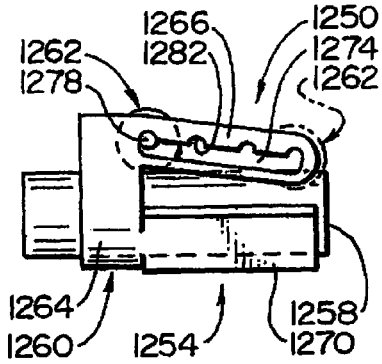
FIG. 71 is a side elevational view of the outlet assembly of FIG. 70.
Figure 72:
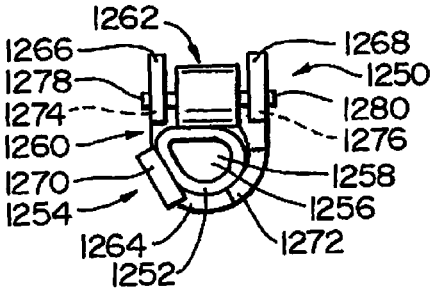
FIG. 72 is an end elevational view of the outlet assembly of FIG. 70 in a reduced outlet area configuration.

Referring now to FIGS. 70, 71, and 72, depicted therein is a portion of yet another exemplary outlet assembly 1250 constructed in accordance with the principles of the present invention. The outlet assembly 1250 includes an actuator member (not shown) constructed in a manner similar to that of the actuator member 1172 on the outlet assembly 1170 described above.

The outlet assembly 1250 comprises an outlet member 1252 and an adjusting assembly 1254. The outlet member 1252 is a hollow cylindrical member that defines an outlet opening 1258 and an outlet passageway 1256. Texture material exits the outlet assembly 1250 through the outlet opening 1258. The outlet member 1252 is also flexible and may be deformed as shown by a comparison of FIGS. 70 and 72 to vary the shape and cross-sectional area of the outlet opening 1258.

The adjustment assembly 1254 comprises a collar member 1260 and a roller member 1262. The collar member 1260 comprises a collar portion 1264 that extends at least partly around the outlet member 1252, first and second roller support flanges 1266 and 1268, and first and second bracing fingers 1270 and 1272. The roller support flanges 1266 and 1268 and bracing fingers 1270 and 1272 extend from the collar portion 1264 and are generally parallel to the longitudinal axis of the outlet member 1252.

First and second roller slots 1274 and 1276 are formed one in each of the roller support flanges 1266 and 1268. These roller slots 1274 and 1276 receive portions 1278 and 1280 that extend from, and along the axis of, the roller member 1262. Only one of the portions 1278 and 1280 may be used. The roller slots 1274 and 1276 and pins 1278 and 1280 interact such that the roller member 1262 can move between a first position shown by solid lines in FIG. 71 and a second position shown by broken lines in FIG. 71.

The roller slots 1274 and 1276 are angled with respect to the longitudinal axis of the outlet member 1252. Accordingly, as the roller member 1262 moves between the first and second positions, the roller member 1262 moves closer to the center axis of the outlet member 1252.

The bracing fingers 1270 and 1272 support the outlet member 1252 on the opposite side of the roller member 1262. Thus, as the roller member 1262 moves closer to the outlet member center axis, the roller member 1262 presses the outlet member 1252 against the bracing fingers 1270 and 1272. This deforms the outlet member 1252, resulting in the different configurations of the outlet opening 1258, as shown by comparing FIGS. 70 and 72. Changing the length and angle of the roller slots 1274 and 1276 changes the amount of deformation of the outlet member 1252.

A plurality of stop notches 1282 are formed on an upper edge of the roller slots 1274 and 1276. The resilient outlet member 1252 opposes the force applied by the roller member 1262 such that the pins 1278 and 1280 are forced into pairs of the stop notches 1282. The exemplary stop notches 1282 define four predetermined positions of the roller member 1262 and thus correspond to four different configurations of outlet openings 1258.

The bracing fingers 1270 and 1272 can be the same shape or differently shaped as shown in FIGS. 70 and 72 to affect the shape of the outlet opening 1258 as the outlet member 1252 is deformed by the roller member 1262.

Referring now to FIGS. 73-76 depicted at 1320 is yet another outlet assembly constructed in accordance with the principles of the present invention. The outlet assembly 1320 comprises an actuator member 1322, an outlet member 1324, and an adjustment member 1326. The actuator member 1322 is designed to be mounted onto a valve assembly of an aerosol container (not shown) and defines an actuator passageway 1328 through which texture material is dispensed. A threaded external surface portion 1330 is formed on the actuator member 1322.

Figure 73:
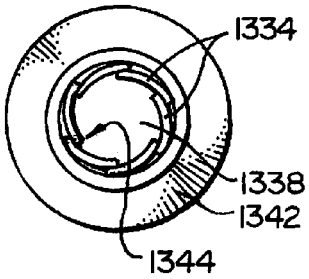
FIG. 73 is an end elevational view of yet another exemplary outlet assembly that may be used with the aerosol assembly of FIG. 52.
Figure 74:
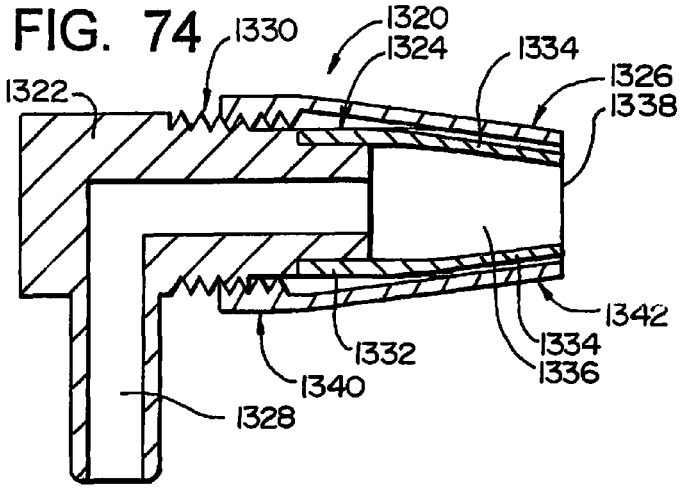
FIG. 74 is a sectional view of the outlet assembly shown in FIG. 73 depicting this outlet assembly in its increased outlet configuration.
Figure 75:
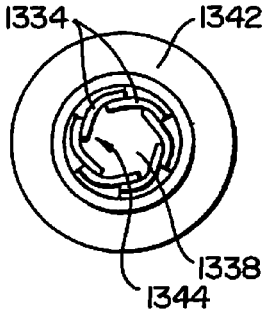
FIG. 75 is an end elevational view of the outlet assembly of FIG. 73 in a reduced outlet area configuration.
Figure 76:
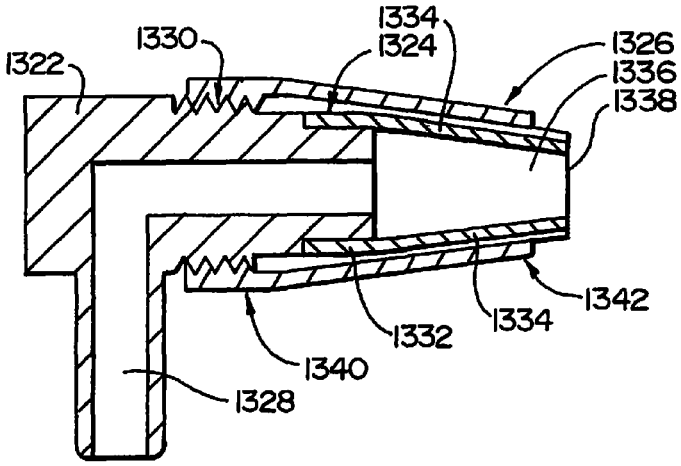
FIG. 76 is a sectional view of the outlet assembly as shown in FIG. 75.

The outlet member 1324 comprises a collar portion 1332 and a plurality of outlet fingers 1334 that are perhaps best shown in FIGS. 73 and 75. The outlet fingers 1334 define an outlet passageway 1336 and an outlet opening 1338. The collar portion 1332 of the outlet member 1324 is mounted to the actuator member 1322 such that the texture material passes through the outlet passageway 1336 after it leaves the actuator passageway 1328. The texture material is dispensed through the outlet opening 1338.

The adjustment member 1326 comprises an annular portion 1340 and a frustoconical engaging portion 1342. The annular portion 1340 is threaded to mate with the threaded exterior surface portion 1330 of the actuator member 1322. With the annular portion 1340 threaded onto the threaded exterior surface portion 1330, the frustoconical engaging portion 1342 surrounds at least a portion of the outlet fingers 1334.

By rotating the adjustment member 1326 about its longitudinal axis, the threaded exterior surface portion 1330 acts on the threaded annular portion 1340 to cause the adjustment member 1326 to move in either direction along its axis. When the adjustment member 1326 moves to the left in FIGS. 74 and 76, its frustoconical engaging portion 1342 acts on the outlet fingers 1334 to reduce the cross-sectional area of the outlet opening 1338. Moving the adjustment member 1326 to the right allows the outlet fingers 1334 to separate and increases the cross-sectional area of the outlet opening 1338.

The differences in the cross-sectional area of the outlet opening 1338 are perhaps best shown by a comparison of FIGS. 73 and 75.

The exemplary outlet member 1324 is formed of a somewhat flexible cylindrical member in which a plurality of cuts or slits are formed to define the outlet fingers 1334. When acted on by the adjustment member 1326, the outlet fingers overlap slightly as shown at 1344 in FIGS. 73 and 75; this overlap increases to obtain the smaller cross-sectional area outlet opening of FIG. 75. An alternative would be to form wider slots in the outlet member such that the outlet fingers do not overlap; as the adjustment member exerts more pressure on the outlet fingers, the gaps therebetween would decrease, and the effective cross-sectional area of the outlet opening would correspondingly decrease.

In either case, the outlet assembly 1320 allows the cross-sectional area of the outlet opening 1338 to be changed, which in turn changes the spray pattern of the texture material and the corresponding texture pattern formed by the deposit of this texture material.

The actuator member 1322 and outlet member 1324 may be formed separately or molded as a single part out of, for example, nylon.

Figure 77:
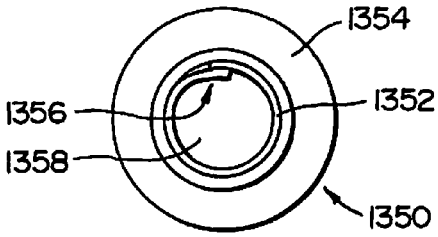
FIG. 77 is an end elevational view of yet another outlet assembly similar to the outlet assembly shown in FIG. 73, that may be used with the aerosol assembly of FIG. 52.
Figure 78:
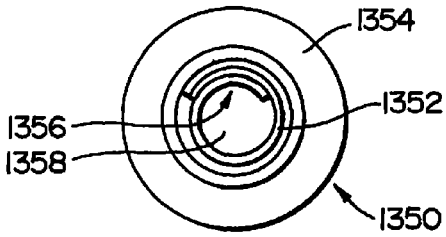
FIG. 78 is an end elevational view of the outlet assembly of FIG. 77 in a reduced outlet area configuration.

Referring now to FIGS. 77 and 78, depicted at 1350 therein is a portion of yet another exemplary outlet assembly constructed in accordance with the principles of the present invention. The outlet assembly 1350 is similar to the outlet assembly 1320 described above and will only be described to the extent that it differs from the assembly 1320.

The outlet assembly 1350 comprises an actuator member (not shown), an outlet member 1352, and an adjustment member 1354. The adjustment member 1354 is constructed and engages the actuator member in the same manner as the adjustment member 1326 of the outlet assembly 1320 described above. The outlet member 1352 is a single sheet of flexible material rolled such that two edges overlap as shown at 1356 in FIGS. 77 and 78.

More specifically, the edges of the outlet member overlap slightly, as shown in FIG. 77, when the adjustment member 1354 is farthest from the actuator member. In this configuration, the outlet member 1352 defines an outlet opening 1358 having a relatively large cross-sectional area. By rotating the adjustment member 1354 such that it moves towards the actuator member, the adjustment member 1354 acts on the outlet member 1352 such that the edges thereof overlap to a greater degree as shown at 1356 in FIG. 78. When this occurs, the cross-sectional area of the outlet opening 1358 is substantially reduced through a continuum of cross-sectional areas. The outlet assembly 1350 thus allows the outlet opening 1358 to be varied to vary the spray pattern obtained and thus the texture pattern in which the texture material is deposited.

Figure 79:
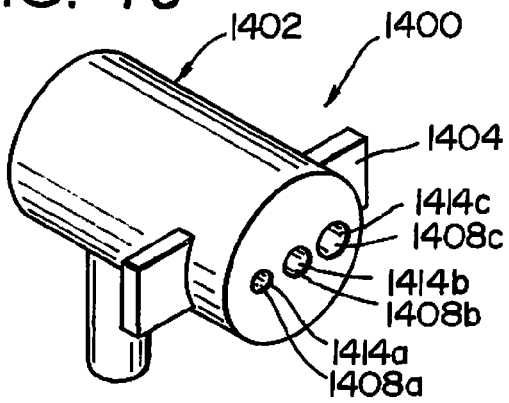
FIG. 79 is a perspective view of yet another outlet assembly that may be used with the aerosol assembly of FIG. 52.
Figure 80:
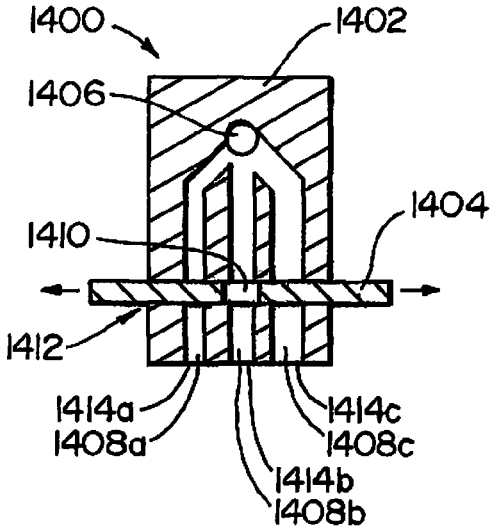
FIG. 80 is a top plan sectional view of the outlet assembly of FIG. 79.

Referring now to FIGS. 79 and 80, depicted therein is yet another outlet assembly 1400 constructed in accordance with the principles of the present invention. The outlet assembly 1400 is designed to dispense texture material in one of three discrete texture patterns.

The outlet assembly 1400 comprises an actuator member 1402 and an adjustment member 1404. The actuator member 1402 is adapted to engage a valve assembly of an aerosol container (not shown) in a conventional manner.

The actuator member 1402 defines an entry passageway 1406 and a plurality of outlet passageways 1408*a*, 1408*b*, and 1408*c*. Texture material flowing through the valve assembly flows initially into the entry passageway 1406 and then out of one of the outlet passageways 1408*a-c* as determined by a position of the adjustment member 1404.

In particular, the outlet passageways 1408*a-c* are each in fluid communication with the entry passageway 1406. The adjustment member 1404 is a relatively rigid rectangular plate in which a through hole 1410 is formed. The adjustment member 1404 is snugly received in an adjustment slot 1412 that extends through the actuator member 1402 and intersects each of the outlet passageways 1408*a-c*.

By sliding the adjustment member 1404 in either direction within the adjustment slot 1412, the through hole 1410 can be aligned with any one of the outlet passageways 1408*a-c;* at the same time, the adjustment member 1404 blocks the other two of the outlet passageways 1408*a-c* with which the through hole 1410 is not aligned. In the exemplary configuration shown in FIG. 80, the through hole 1410 is aligned with the centermost outlet passageway 1408*b* and the adjustment member 1404 blocks the outlet passageways 1408*a* and 1408*c*.

Each of the outlet passageways 1408*a-c* is provided with a different cross-sectional area; accordingly, outlet openings 1414*a*, 1414*b*, and 1414*c* defined by the outlet passageways 1408*a-c* all have different cross-sectional areas and thus create different spray patterns. The position of the adjustment member 1404 thus corresponds to one of three texture patterns and can be configured as necessary to obtain a desired texture pattern that matches a pre-existing texture pattern.

Figure 81:
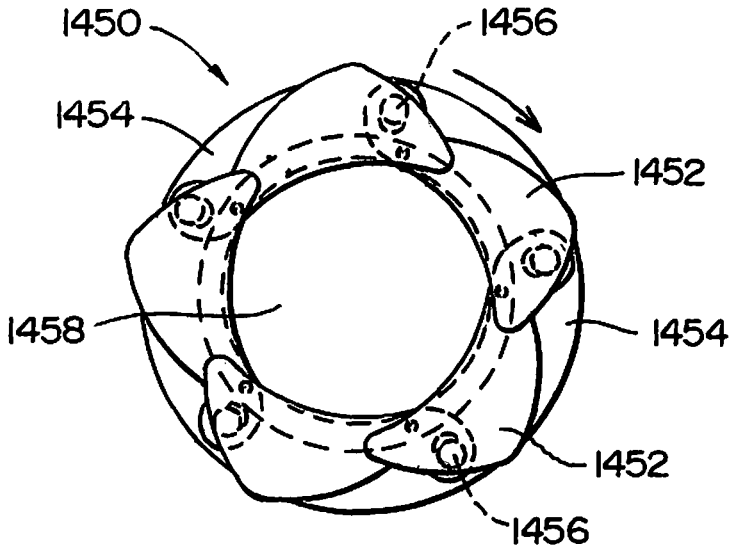
FIG. 81 is an end elevational view of yet another outlet assembly that may be used with the aerosol assembly of FIG. 52.
Figure 82:
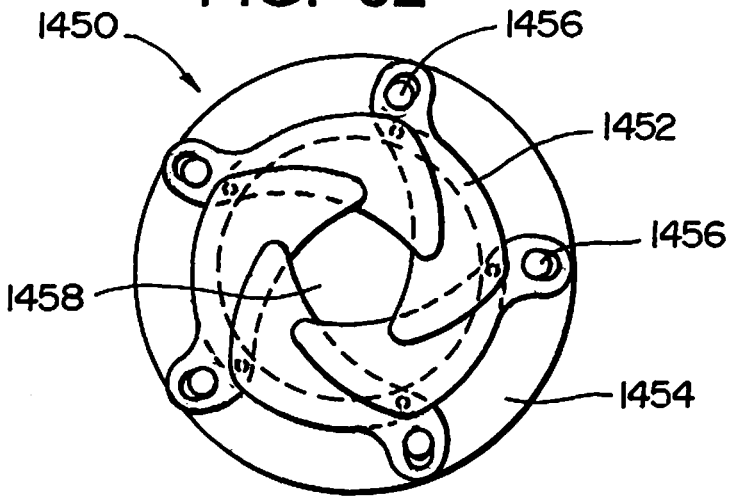
FIG. 82 is an end elevational view of the outlet assembly of FIG. 81 in a reduced outlet area configuration.

Referring now to FIGS. 81 and 82, depicted at 1450 therein is a portion of yet another outlet assembly constructed in accordance with, and embodying, the principles of the present invention. The outlet assembly 1450 comprises an actuator member (not shown) that engages and operates a valve assembly. The actuator member defines an actuator passageway through which texture material is dispensed when the valve assembly is in the open configuration.

Mounted onto the actuator member are a plurality of shutter plates 1452 that are pivotably attached to a mounting ring 1454 by pivot projections 1456. The mounting ring 1454 is in turn rotatably attached to the actuator member. Rotation of the mounting ring 1454 relative to the actuator member causes the shutter plates 1452 to pivot about the pivot projections 1456 between outer positions as shown in FIG. 81 and inner positions as shown in FIG. 82.

The shutter plates 1452 define an outlet opening 1458. As can be seen by a comparison of FIGS. 81 and 82, the shape and cross-sectional area of the outlet opening 1458 changes as the shutter plates 1452 move between their outer positions and inner positions. Texture material dispensed from the dispensing system including the outlet assembly 1450 last passes through the outlet opening 1458; this opening 1458 thus determines the spray pattern in which the texture material is dispensed.

Operating the outlet assembly 1450 such that the shutter plates 1452 move between their outer and inner positions thus allows the user to select a desired texture pattern in which the texture material is deposited. The desired texture pattern may match a pre-existing texture pattern such as one of a plurality of standard texture patterns or the texture pattern on a wall or other surface to be repaired.

It is to be recognized that various modifications can be made without departing from the basic teaching of the present invention.

What is claimed is:

1. An outlet assembly for a spray dispenser, comprising:

an actuator member, where the actuator member comprises a stem portion, a first displacement surface portion, and at least one finger;

an outlet member defining an outlet opening, where the outlet member is deformable;

an adjustment member defining a second displacement surface portion and an adjustment edge; whereby the outlet member is arranged adjacent to the actuator member such that the outlet member and the actuator member define a dispensing path, and the outlet member is adjacent to the at least one finger;

the adjustment member is arranged relative to the actuator member such that the first and second displacement surfaces engage each other, and the adjustment edge is in contact with the at least one finger; and movement of the adjustment member relative to the actuator member displaces the adjustment member relative to the actuator member to cause the adjustment edge to deform the at least one finger; and as the adjustment edge deforms the at least one finger, the at least one finger deforms the outlet member to alter a cross-sectional area of the outlet opening.

2. An outlet assembly for a spray dispenser, comprising:

an actuator member, where the actuator member comprises a stem portion, and an adjustment edge;

an outlet member defining an outlet opening, where the outlet member is deformable;

a first adjustment member defining a first displacement surface portion, and at least one finger; and a second adjustment member defining a second displacement surface portion; wherein the outlet member is arranged adjacent to the actuator member and the first adjustment member such that the outlet member, the actuator member, and the first adjustment member define a dispensing path, the outlet member is adjacent to the at least one finger, and the adjustment edge is in contact with the at least one finger;

the second adjustment member is arranged relative to the first adjustment member such that the first and second displacement surfaces engage each other; and movement of the first adjustment member relative to the second adjustment member displaces the first adjustment member relative to the actuator member to cause the adjustment edge to deform the at least one finger; and as the adjustment edge deforms the at least one finger, the at least one finger deforms the outlet member to alter a cross-sectional area of the outlet opening.

3. An outlet assembly for a spray dispenser, comprising:

an actuator member, where the actuator member comprises a stem portion, and at least one finger;

an outlet member defining an outlet opening, where the outlet member is deformable;

a first adjustment member defining a first displacement surface portion, and an adjustment edge; and a second adjustment member defining a second displacement surface portion; wherein the outlet member is arranged adjacent to the actuator member such that the outlet member and the actuator member define a dispensing path, and the outlet member is adjacent to the at least one finger;

the first adjusting member is arranged adjacent to the actuator member such that the adjustment edge is in contact with the at least one finger;

the second adjustment member is arranged relative to the first adjustment member such that the first and second displacement surfaces engage each other; and movement of the first adjustment member relative to the second adjustment member displaces the first adjustment member relative to the actuator member to cause the adjustment edge to deform the at least one finger; and as the adjustment edge deforms the at least one finger, the at least one finger deforms the outlet member to alter a cross-sectional area of the outlet opening.

* * * * *